US011092904B2

(12) United States Patent
Shimizu

(10) Patent No.: US 11,092,904 B2
(45) Date of Patent: Aug. 17, 2021

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventor: Tomofumi Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/632,239

(22) PCT Filed: Jun. 26, 2018

(86) PCT No.: PCT/JP2018/024139
§ 371 (c)(1),
(2) Date: Jan. 17, 2020

(87) PCT Pub. No.: WO2019/017160
PCT Pub. Date: Jan. 24, 2019

(65) Prior Publication Data

US 2020/0174386 A1 Jun. 4, 2020

(30) Foreign Application Priority Data

Jul. 21, 2017 (JP) ..... JP2017-141458

(51) Int. Cl.
*G03G 5/06* (2006.01)
*G03G 5/05* (2006.01)

(52) U.S. Cl.
CPC ..... *G03G 5/0696* (2013.01); *G03G 5/056* (2013.01); *G03G 5/0614* (2013.01); *G03G 5/0618* (2013.01); *G03G 5/0664* (2013.01); *G03G 5/0668* (2013.01); *G03G 5/0677* (2013.01); *G03G 5/061443* (2020.05); *G03G 5/061446* (2020.05)

(58) Field of Classification Search
CPC ..... G03G 5/061443; G03G 5/061446
See application file for complete search history.

(56) References Cited

U.S. PATENT DOCUMENTS 7,919,220 B2 4/2011 Shimoyama et al.
10,133,198 B2 11/2018 Zhu et al.
10,191,397 B2 1/2019 Maruo et al.
(Continued)

FOREIGN PATENT DOCUMENTS

JP 2002-214806 A 7/2002
JP 2008-122740 A 5/2008
(Continued)

*Primary Examiner* — Christopher D Rodee
(74) *Attorney, Agent, or Firm* — Studebaker & Brackett PC

(57) ABSTRACT

A single-layer photosensitive layer of an electrophotographic photosensitive member contains a charge generating material, a hole transport material, an electron transport material, and a binder resin. The charge generating material is a phthalocyanine pigment. A content percentage of the phthalocyanine pigment relative to the mass of the photosensitive layer is at least 0.70% by mass and no greater than 1.40% by mass. A film thickness of the photosensitive layer is at least 25 μm and no greater than 32 μm. A charge amount difference ΔQ is no greater than 6.50 μC.

12 Claims, 4 Drawing Sheets

(56) References Cited

U.S. PATENT DOCUMENTS

| | | | | |
|---|---|---|---|---|
| 2008/0113286 | A1 | 5/2008 | Shimoyama et al. | |
| 2017/0269487 | A1* | 9/2017 | Zhu | G03G 5/0517 |
| 2018/0024449 | A1* | 1/2018 | Zhu | G03G 5/056<br>430/58.2 |
| 2018/0046100 | A1 | 2/2018 | Maruo et al. | |
| 2018/0046101 | A1* | 2/2018 | Shimizu | G03G 5/0605 |
| 2019/0354027 | A1* | 11/2019 | Shimizu | G03G 5/0616 |

FOREIGN PATENT DOCUMENTS

| | | | |
|---|---|---|---|
| JP | 2008-224785 | A | 9/2008 |
| JP | 2014-092582 | A | 5/2014 |
| JP | 2014-092594 | A | 5/2014 |
| JP | 2018-025656 | A | 2/2018 |
| WO | 2016/199283 | A1 | 12/2016 |

* cited by examiner

ELECTROPHOTOGRAPHIC PHOTOSENSITIVE MEMBER, PROCESS CARTRIDGE, AND IMAGE FORMING APPARATUS

TECHNICAL FIELD

The present disclosure relates to an electrophotographic photosensitive member, a process cartridge, and an image forming apparatus.

BACKGROUND ART

An electrophotographic photosensitive member is used as an image bearing member in an electrophotographic image forming apparatus (for example a printer or a multifunction peripheral). In general, an electrophotographic photosensitive member includes a photosensitive layer. The photosensitive layer contains for example a charge generating material, a charge transport material (more specifically, a hole transport material or an electron transport material), and a resin for binding these materials (a binder resin). For example, the electrophotographic photosensitive member contains the charge generating material and the charge transport material in one layer (the photosensitive layer) and has both functions of charge generation and charge transportation in the one layer. Such an electrophotographic photosensitive member is referred to as a single-layer electrophotographic photosensitive member.

Patent Literature 1 describes an electrophotographic photosensitive member containing a bisphenol Z polycarbonate resin as the binder resin.

CITATION LIST

Patent Literature

Patent Literature 1: Japanese Patent Application Laid-Open Publication No. 2002-214806

SUMMARY OF INVENTION

Technical Problem

However, the technique described in Patent Literature 1 was insufficient for improving toner image transferring performance and sensitivity characteristics of the electrophotographic photosensitive member.

The present invention was made in view of the above problem, and an object of the present invention is to provide an electrophotographic photosensitive member excellent in toner image transferring performance and sensitivity characteristics. Another object of the present invention is to provide a process cartridge and an image forming apparatus excellent in toner image transferring performance and sensitivity characteristics.

Solution to Problem

An electrophotographic photosensitive member according to the present invention includes a conductive substrate and a photosensitive layer. The photosensitive layer is a single-layer photosensitive layer. The photosensitive layer contains a charge generating material, a hole transport material, an electron transport material, and a binder resin. The charge generating material is a phthalocyanine pigment. A content percentage of the phthalocyanine pigment relative to the mass of the photosensitive layer is at least 0.70% by mass and no greater than 1.40% by mass. The film thickness of the photosensitive layer is at least 25 μm and no greater than 32 μm. The charge amount difference ΔQ on a surface of the photosensitive layer is no greater than 6.50 μC. The charge amount difference ΔQ is calculated based on mathematical expression (1).

$$\Delta Q = Q_1 - Q_2 \quad (1)$$

In mathematical expression (1), $Q_1$ represents a charge amount of a non-exposed region of the surface of the photosensitive layer. $Q_2$ represents a charge amount of an exposed region of the surface of the photosensitive layer. The exposed region is a region of the surface of the photosensitive layer charged to +600 V and then irradiated with exposure light having a wavelength of 780 nm and an exposure amount of 1.2 μJ/cm$^2$, and the non-exposed region is a region of the surface of the photosensitive layer charged to +600 V and not irradiated with the exposure light thereafter.

A process cartridge according to the invention includes the electrophotographic photosensitive member described above.

An image forming apparatus according to the present invention includes an image bearing member, a charger, a light exposure section, a developing section, and a transfer section. The image bearing member is the electrophotographic photosensitive member described above. The charger positively charges a surface of the image bearing member. The light exposure section forms an electrostatic latent image by irradiating the charged surface of the image bearing member with exposure light. The developing section develops the electrostatic latent image into a toner image. The transfer section transfers the toner image from the surface of the image bearing member to a recording medium.

Advantageous Effects of Invention

The electrophotographic photosensitive member according to the present invention is excellent in toner image transferring performance and sensitivity characteristics. In addition, the process cartridge and an image forming apparatus according to the present invention are excellent in toner image transferring performance and sensitivity characteristics.

DESCRIPTION OF EMBODIMENTS

Figure 1A:
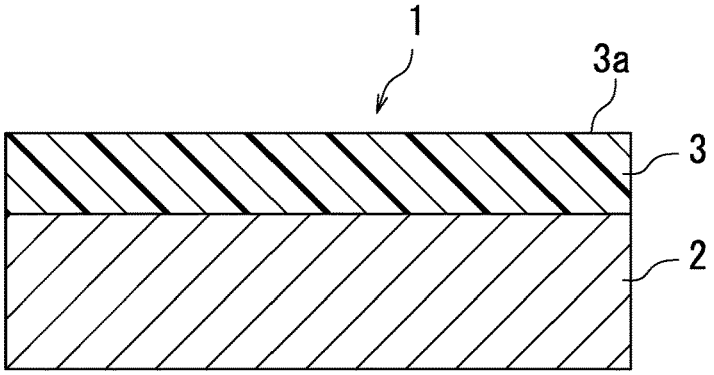
FIG. 1A is a schismatic cross sectional view illustrating a structure of an electrophotographic photosensitive member according to a first embodiment.

The following describes embodiments of the present invention in detail. However, the present invention is by no means limited to the following embodiments. The present invention can be practiced within a scope of objects of the present invention with alterations made as appropriate. Although some overlapping explanations may be omitted as appropriate, such omission does not limit the gist of the present disclosure.

In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In addition, a group "optionally having a group", a group "having a group", a group "optionally having a halogen atom", and a group "having a halogen atom" respectively represent a group "optionally substituted with a group", a group "substituted with a group", a group "optionally substituted with a halogen atom", and a group "substituted with a halogen atom".

Hereinafter, a halogen atom, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, a cycloalkyl ring having a carbon number of at least 5 and no greater than 7, an aryl group having a carbon number of at least 6 and no greater than 14, an alkoxy group having a carbon number of at least 1 and no greater than 6, and an alkoxy group having a carbon number of at least 1 and no greater than 3 each represent the following unless otherwise stated.

Examples of the halogen atom include a fluorine atom, a chlorine atom, a bromine atom, and an iodine atom.

An alkyl group having a carbon number of at least 1 and no greater than 6 as used herein is an unsubstituted straight chain or branched chain alkyl group. Examples of the alkyl group having a carbon number of at least 1 and no greater than 6 include a methyl group, an ethyl group, an n-propyl group, an isopropyl group, an n-butyl group, an s-butyl group, a t-butyl group, a pentyl group, an isopentyl group, a neopentyl group, and an n-hexyl group.

An alkyl group having a carbon number of at least 1 and no greater than 5 as used herein is an unsubstituted straight chain or branched chain alkyl group. Examples of the alkyl group having a carbon number of at least 1 and no greater than 5 include a methyl group, an ethyl group, an n-propyl group, an isopropyl group, an n-butyl group, an s-butyl group, a t-butyl group, a pentyl group, an isopentyl group, and a neopentyl group.

An alkyl group having a carbon number of at least 1 and no greater than 4 as used herein is an unsubstituted straight chain or branched chain alkyl group. Examples of the alkyl group having a carbon number of at least 1 and no greater than 4 include a methyl group, an ethyl group, an n-propyl group, an isopropyl group, an n-butyl group, an s-butyl group, and a t-butyl group.

An alkyl group having a carbon number of at least 1 and no greater than 3 as used herein is an unsubstituted straight chain or branched chain alkyl group. Examples of the alkyl group having a carbon number of at least 1 and no greater than 3 include a methyl group, an ethyl group, an n-propyl group, and an isopropyl group.

A cycloalkyl ring having a carbon number of at least 5 and no greater than 7 as used herein is an unsubstituted ring. Examples of the cycloalkyl ring having a carbon number of at least 5 and no greater than 7 include a cyclopentane ring, a cyclohexane ring, and a cycloheptane ring.

An aryl group having a carbon number of at least 6 and no greater than 14 as used herein is an unsubstituted aryl group. Examples of the aryl group having a carbon number of at least 6 and no greater than 14 include an unsubstituted monocyclic aromatic hydrocarbon group having a carbon number of at least 6 and no greater than 14, an unsubstituted fused bicyclic aromatic hydrocarbon group having a carbon number of at least 6 and no greater than 14, and an unsubstituted fused tricyclic aromatic hydrocarbon group having a carbon number of at least 6 and no greater than 14. Examples of the aryl group having a carbon number of at least 6 and no greater than 14 include a phenyl group, a naphthyl group, an anthryl group, and a phenanthryl group.

An alkoxy group having a carbon number of at least 1 and no greater than 6 as used herein is an unsubstituted straight chain or branched chain alkoxy group. Examples of the alkoxy group having a carbon number of at least 1 and no greater than 6 include a methoxy group, an ethoxy group, an n-propoxy group, an isopropoxy group, an n-butyloxy group, an s-butyloxy group, a t-butoxy group, an n-pentyloxy group, a t-pentyloxy group, and an n-hexyloxy group.

An alkoxy group having a carbon number of at least 1 and no greater than 3 as used herein is an unsubstituted straight chain or branched chain alkoxy group. Examples of the alkoxy group having a carbon number of at least 1 and no greater than 3 include a methoxy group, an ethoxy group, an n-propoxy group, and an isopropoxy group.

First Embodiment: Electrophotographic Photosensitive Member

Figure 1B:
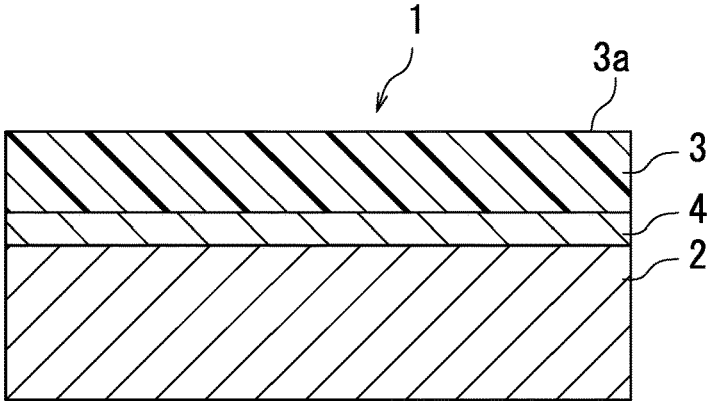
FIG. 1B is a schismatic cross sectional view illustrating a structure of the electrophotographic photosensitive member according to the first embodiment.
Figure 1C:
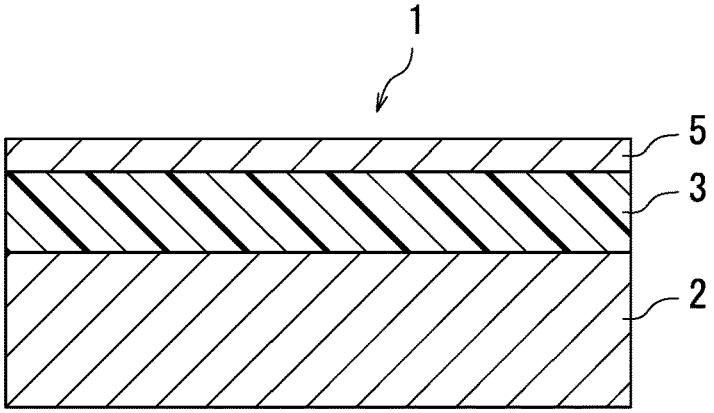
FIG. 1C is a schismatic cross sectional view illustrating a structure of the electrophotographic photosensitive member according to the first embodiment.

The following describes structure of an electrophotographic photosensitive member 1 (also referred to below as a photosensitive member) with reference to FIGS. 1A to 1C. FIGS. 1A to 1C are each a schismatic cross sectional view illustrating a structure of the photosensitive member 1. The photosensitive member 1 includes a conductive substrate 2 and a photosensitive layer 3. The photosensitive layer 3 is a photosensitive layer 3 having a single layer (single-layer photosensitive layer). The photosensitive layer 3 is disposed directly or indirectly on the conductive substrate 2. The photosensitive layer 3 may be located directly on the conductive substrate 2 for example as illustrated in FIG. 1A. An intermediate layer 4 may be disposed between the conductive substrate 2 and the photosensitive layer 3 for example as illustrated in FIG. 1B. Alternatively, the photosensitive layer 3 may be exposed as an outermost layer as illustrated in FIGS. 1A and 1B. A protective layer 5 may be disposed on the photosensitive layer 3 as illustrated in FIG. 1C.

The photosensitive member 1 according to the first embodiment is excellent in sensitivity characteristics and toner image transferring performance. Presumably, the reason therefor is as follows.

For the sake of convenience, degradation in transferring performance will be described first. An electrophotographic image forming apparatus includes for example an image bearing member (photosensitive member 1), a charger, a light exposure section, a developing section, and a transfer section. The transfer section transfers a toner image from the photosensitive member 1 to a recording medium. The transfer section applies a transfer bias to the toner image. As the transfer bias, a negative voltage having a reverse polarity to the charging polarity of the toner image (positive polarity) is applied. In this case, if a surface potential (post-exposure potential) of an exposed region of the photosensitive layer surface 3*a* and a surface potential (charged potential) of a non-exposed region thereof are significantly different, (for example, a charge amount difference ΔQ is greater than 6.50 μC), the toner image in the exposed region may be blocked by an electric field caused by the surface potential of the non-exposed region around the exposed region. As a result, an effective electric field for transferring the toner image to the recording medium may fail to be formed. The lack of an effective electric field is assumed to cause degradation in toner image transferring performance. Such a defect tends to occur in an image pattern of a thin line, a character, or an island-shaped pattern.

The following describes an image defect caused by degradation in toner image transferring performance. When toner image transferring performance is degraded, the toner image cannot be entirely transferred and partially remains on the photosensitive member 1. The remaining toner is called an untransferred toner residue. When a rotation of the photosensitive member 1 in an image forming process is referred to as a reference rotation, the untransferred toner residue is transferred in a rotation subsequent to the reference rotation to form an image corresponding to the image on the reference rotation. In this way, an image defect caused by degradation in toner image transferring performance occurs.

Figure 2:
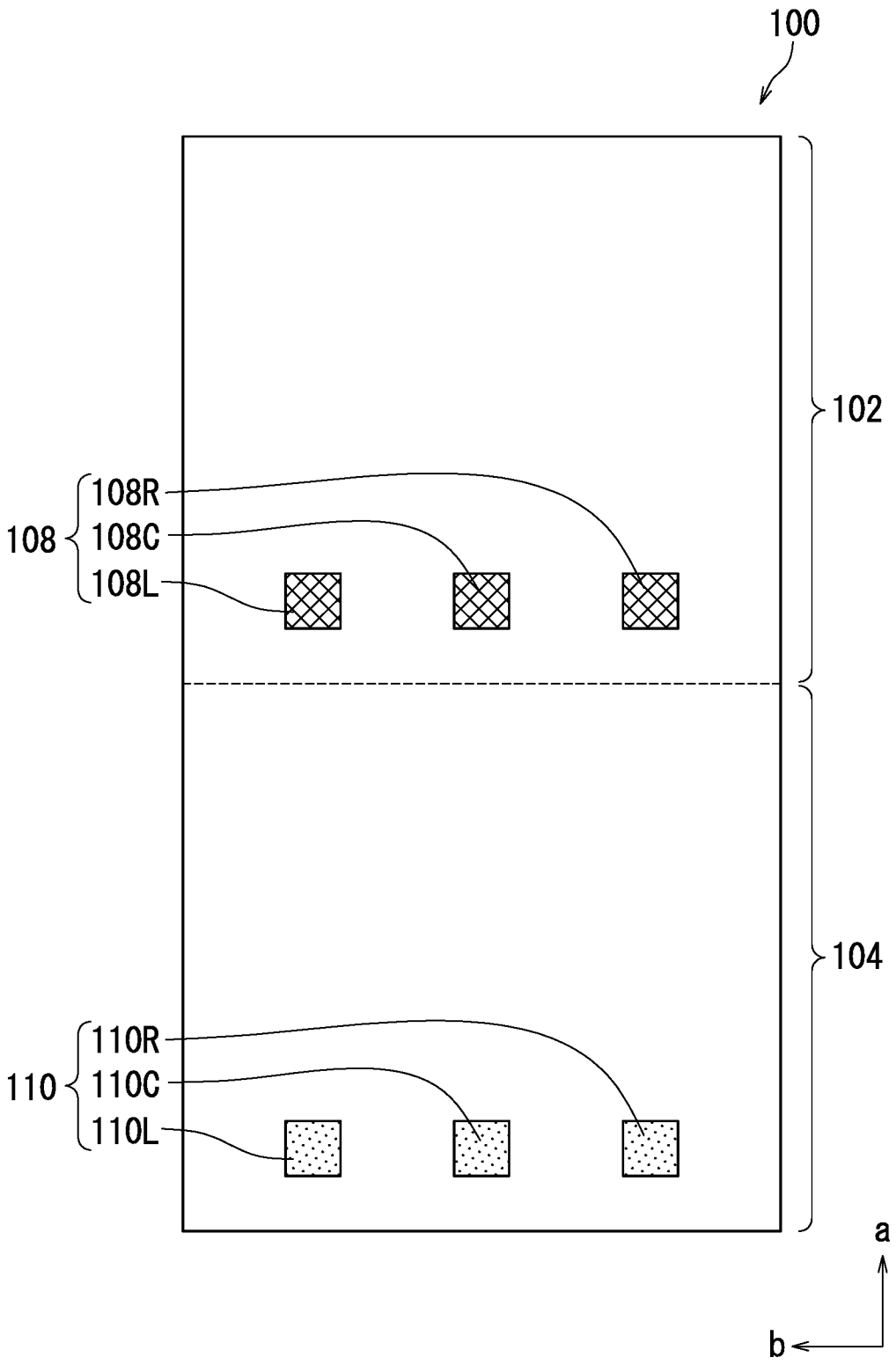
FIG. 2 is a view illustrating an image in which an image defect has occurred.
Figure 4:
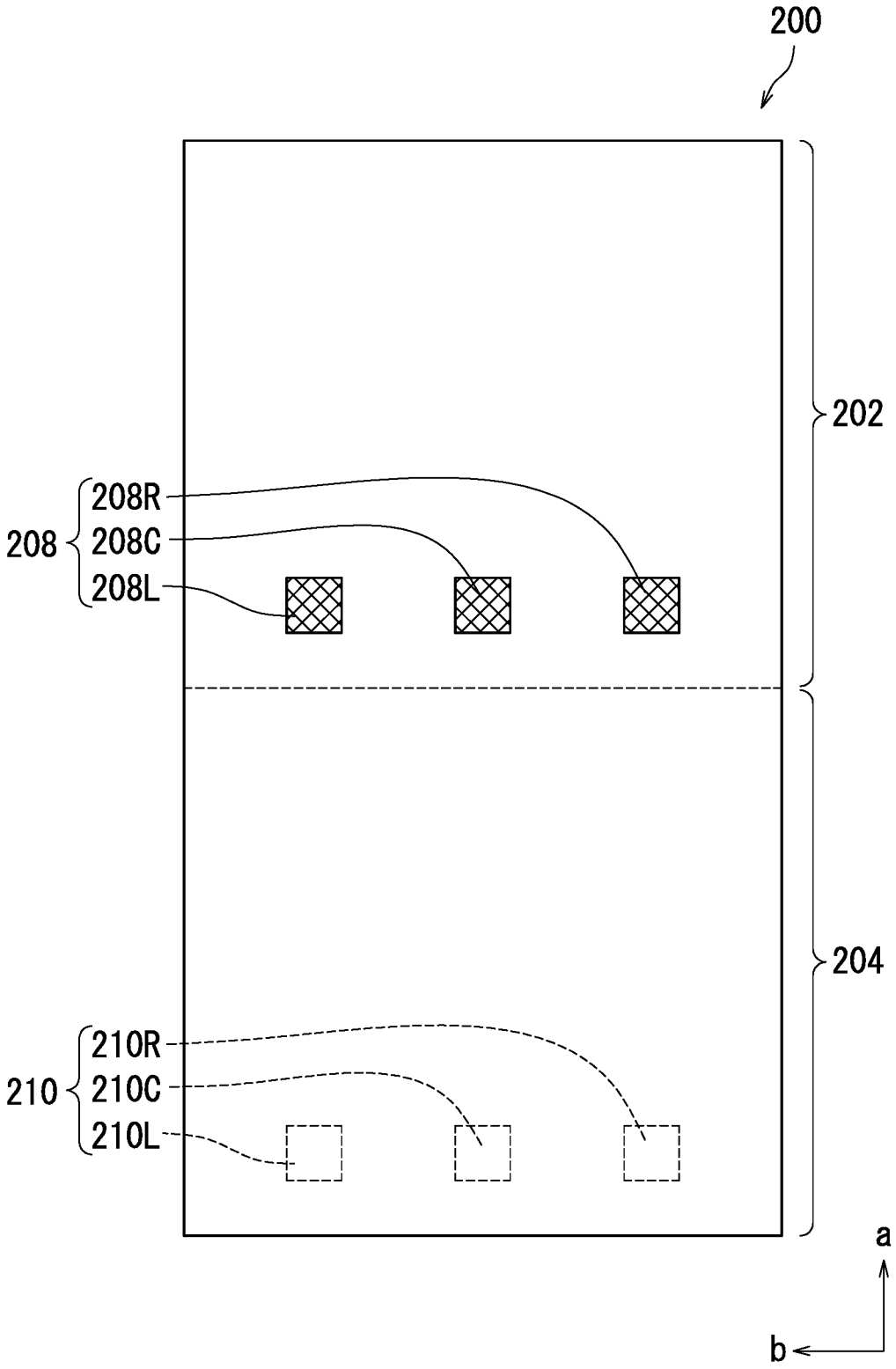
FIG. 4 is a view of an evaluation image.

With reference to FIG. 2, the following further describes an image in which an image defect has occurred. FIG. 2 illustrates an image formed with a photosensitive member of a reference example having an image defect caused by degradation in toner image transferring performance. In FIG. 2 and FIG. 4, which will be described later, "a" represents a direction a in which a recording medium is conveyed (referred to below as a conveyance direction a), and "b" represents a direction b perpendicular to the conveyance direction a. An image 100 has a region 102 and a region 104. The regions 102 and 104 each correspond to one rotation of the photosensitive member 1. The image 108 in the region 102 includes three square images 108L, 108C, and 108R (solid images, image density: 100%). The region 104 is constituted by an entirely white image (image density: 0%) in design. In the conveyance direction a, the image 108 in the region 102 is formed first and then a white image in the region 104 is formed. The white image in the region 104 is an image corresponding to one rotation (next rotation) of the photosensitive member 1. That is, the white image in the region 104 is an image corresponding to one rotation of the photosensitive member 1 as a second rotation next to the reference rotation of the photosensitive member 1 forming the image 108.

The image 110 in the region 104 (more specifically, the images 110L, 110C, and 110R) is an image corresponding to the image 108 (more specifically, each image 108L, 108C, and 108R) in the second rotation next to the reference rotation of the photosensitive member 1. In this situation, an image defect caused by degradation in toner image transferring performance of the photosensitive member 1 may occur per cycle of a circumferential length of the photosensitive member 1 as a unit.

The photosensitive member 1 according to the first embodiment has a charge amount difference ΔQ no greater than 6.50 μC. In a case where the charge amount difference ΔQ is no greater than 6.50 μC, a transfer bias applied to the photosensitive layer surface 3*a* in a transfer process tends not to be blocked by an electric field caused by the surface potential of a non-exposed region. As described above, an effective electric field for transferring a toner image to a recording medium tends to be formed with use of the photosensitive member 1 according to the first embodiment in a transfer process.

The photosensitive layer 3 of the photosensitive member 1 according to the first embodiment has a film thickness of at least 25 μm and no greater than 32 μm. When the film thickness of the photosensitive layer 3 is less than 25 μm, surface charge density tends to excessively increase, resulting in a tendency for an appropriate charge amount difference ΔQ not to be attained in an electrostatic latent image. In such a situation, toner image transferring performance degradates. On the other hand, when the film thickness of the photosensitive layer 3 is greater than 32 μm, a distance over which carriers (in particular, holes) are transported tends to increase. In such a situation, carriers are more likely to be trapped in the photosensitive layer 3, resulting in impairment in sensitivity characteristics of the photosensitive member 1. In order to particularly improve toner image transferring performance, the film thickness of the photosensitive layer 3 is preferably at least 27 μm and no greater than 32 μm. Note that the film thickness of the photosensitive layer 3 may be at least 25 μm and no greater than 27 μm, at least 27 μm and no greater than 30 μm, or at least 30 μm and no greater than 32 μm.

The photosensitive member 1 according to the first embodiment has a content percentage of the charge generating material (phthalocyanine pigment) relative to the mass of the photosensitive layer 3 of at least 0.70% by mass and no greater than 1.40% by mass. When the content percentage of the charge generating material is less than 0.70% by mass, carriers decrease in number, resulting in less easy formation of an electrostatic latent image and impairment in sensitivity characteristics of the photosensitive member. When the content percentage of the charge generating material is less than 0.70% by mass or greater than 1.40% by mass, specific permittivity of the photosensitive member varies, resulting in failure to attain an appropriate charge amount difference ΔQ in an electrostatic latent image. In such a situation, toner image transferring performance degrades. From the above, the photosensitive member 1 according to the first embodiment is thought to be excellent in sensitivity characteristics and toner image transferring performance.

In addition, when the content percentage of the charge generating material is at least 0.70% by mass and no greater than 1.40% by mass relative to the mass of the photosensitive layer 3, capacitance of the photosensitive layer 3 can be controlled within an appropriate numeric range. In order to particularly improve toner image transferring performance, the content percentage of the charge generating material is preferably at least 0.70% by mass and no greater than 1.00% by mass relative to the mass of the photosensitive layer 3. Note that the content percentage of the charge generating material may be at least 0.70% by mass and no greater than 0.80% by mass relative to the mass of the photosensitive layer 3, at least 0.80% by mass and no greater than 1.00% by mass, at least 1.00% by mass and no greater than 1.20% by mass, or at least 1.20% by mass and no greater than 1.40% by mass.

The charge amount difference ΔQ is preferably at least 4.00 μC and no greater than 6.50 μC, and more preferably at least 4.00 μC and no greater than 6.20 μC. When the charge amount difference ΔQ is at least 4.00 μC, toner is likely not to be transferred to a non-exposed region but to be transferred to an exposed region, resulting in a tendency to form a toner image reflecting an electrostatic latent image.

(Charge Amount Difference ΔQ)

The following describes a method for calculating a charge amount difference ΔQ of the photosensitive member 1 in detail. The charge amount difference ΔQ is calculated based on the following mathematical expression (1).

$$\Delta Q = Q_1 - Q_2 \quad (1)$$

In mathematical expression (1), $Q_1$ and $Q_2$ respectively represent a charge amount Q in a non-exposed region and a charge amount Q in an exposed region of the photosensitive layer surface 3*a*.

The charge amount difference ΔQ is calculated based on the following mathematical expression (2).

$$Q = C \times V \quad (2)$$

In mathematical expression (2), C represents a capacitance of the photosensitive layer 3. V represents a surface potential of the photosensitive layer 3. The exposed region is a region of the surface of the photosensitive layer 3 charged to +600 V and then irradiated with exposure light having a wavelength of 780 nm and an exposure amount of 1.2 μJ/cm$^2$, and the non-exposed region is a region of the surface of the photosensitive layer 3 charged to +600 V and not irradiated with the exposure light thereafter. The charge amount $Q_1$ of the non-exposed region of the photosensitive layer surface 3*a* is preferably at least 5.60 μC and no greater than 7.40 μC. The charge amount $Q_2$ of the exposed region of the photosensitive layer surface 3*a* is preferably at least 0.90 μC and no greater than 1.60 μC. The charge amounts $Q_1$ and $Q_2$ represent a charge amount in the non-exposed region and a charge amount in the exposed region, respectively, per specified area (97.85 cm$^2$) of the photosensitive layer surface 3*a*.

The capacitance C of the photosensitive layer 3 is calculated as follows. Charge amounts Q of the photosensitive layer 3 are plotted against corresponding surface potentials V of the photosensitive layer 3. The least squares method is used to obtain a capacitance C(=Q/V) corresponding to a slope of the plotting.

The following describes a method for measuring the charge amount Q and the surface potential V of the photosensitive layer 3. The photosensitive member 1 is mounted in an evaluation apparatus. A drum testing machine (product of GENTEC) is used as the evaluation apparatus. The evaluation apparatus includes a corotron charger as a charger. The rotational speed of the photosensitive member 1 is 31 rpm. The static elimination light intensity is 480 μW. The electric current applied to the photosensitive layer surface 3*a* is changed (drum current: +4 μA, +5 μA, +6 μA, and +7 μA), and the charge amount Q and the surface potential V at each applied current are measured.

The charge amount $Q_1$ of the non-exposed region and the charge amount $Q_2$ of the exposed region are expressed by the following mathematical expressions (3) and (4), respectively.

$$Q_1 = C \times V_0 \quad (3)$$

$$Q_2 = C \times V_L \quad (4)$$

In mathematical expressions (3) and (4), C represents a capacitance of the photosensitive layer 3. $V_0$ represents a surface potential (charge potential) of the charged photosensitive layer 3. $V_L$ represents a surface potential of an exposed region of the photosensitive layer 3 after exposure (post-exposure potential).

The following describes a method for measuring the charge potential $V_0$ and the post-exposure potential $V_L$. The photosensitive member 1 is mounted in an evaluation apparatus. A modified version of a printer ("FS-1300D", product of KYOCERA Document Solutions Inc.) is used as the evaluation apparatus. The evaluation apparatus includes a charger, a light exposure section, a measuring section, and a transfer section. The photosensitive member 1 has a linear speed of 165 mm/sec. The charger is a scorotron charger. The grid voltage is +600 V. The charge potential is +600 V. The wavelength of the exposure light is 780 nm. The exposure amount is 1.2 μJ/cm$^2$. The measuring section is constituted by an electrometer ("MODEL 244", product of Monroe Electronics) and a surface potential probe ("MODEL 1017AE", product of Monroe Electronics). The measuring section is disposed at a location where a developing section is originally located. The transfer current is −21 μA. The measurement is performed at a temperature of 23° C. and a relative humidity of 50%. Note that the set value of the charge potential $V_0$ is +600 V, and the set value of the post-exposure potential $V_L$ is 0 V. The measurement target is a specified area (97.85 cm$^2$) of the photosensitive layer surface 3*a*.

(Film Thickness of Photosensitive Layer)

The film thickness of the photosensitive layer 3 is measured using a film thickness measuring device ("FISCHERSCOPE (registered Japanese trademark) mms (registered Japanese trademark)", product of HELMUTFISCHER). The measurement is performed at a temperature of 23° C. and a relative humidity of 50%.

[Conductive Substrate]

No particular limitations are placed on the conductive substrate 2 as long as the conductive substrate 2 can be used in the photosensitive member 1. It is only required that at least a surface portion of the conductive substrate 2 is formed from a material having conductivity (also referred to below as a conductive material). An example of the conductive substrate 2 is a conductive substrate formed from a conductive material. Another example of the conductive substrate 2 is a conductive substrate covered with a conductive material. Examples of conductive materials include aluminum, iron, copper, tin, platinum, silver, vanadium, molybdenum, chromium, cadmium, titanium, nickel, palladium, and indium. Any one of the conductive materials may be used independently, or any two or more of the conductive materials may be used in combination. Examples of combinations of two or more of the conductive materials include alloys (specific examples include aluminum alloys, stainless steel, and brass). Among the conductive materials listed above, aluminum or an aluminum alloy is preferable in terms of favorable charge mobility from the photosensitive layer 3 to the conductive substrate 2.

The shape of the conductive substrate 2 can be appropriately selected according to a configuration of an image forming apparatus to be used. The conductive substrate 2 is for example in a sheet shape or a drum shape. The thickness of the conductive substrate 2 is appropriately selected according to the shape of the conductive substrate 2.

[Photosensitive Layer]

The photosensitive layer 3 contains a charge generating material, a hole transport material, an electron transport material, and a binder resin. The photosensitive layer 3 may contain an additive as necessary. The following describes the charge generating material, the electron transport material, the hole transport material, the binder resin, and the additive.

(Charge Generating Material)

The charge generating material is a phthalocyanine pigment. Examples of the phthalocyanine pigment include metal-free phthalocyanine represented by chemical formula (CGM-1) and metal phthalocyanine. Examples of the metal phthalocyanine include titanyl phthalocyanine represented by chemical formula (CGM-2), and phthalocyanine coordinated with a metal other than titanium oxide (specific examples include V-type hydroxygallium phthalocyanine). The phthalocyanine pigment may be crystalline or non-crystalline. No particular limitations are placed on the crystal structure (for example, α-form, β-form, or Y-form) of the phthalocyanine pigment and phthalocyanine pigments of various crystal structures may be used.

(CGM-1)

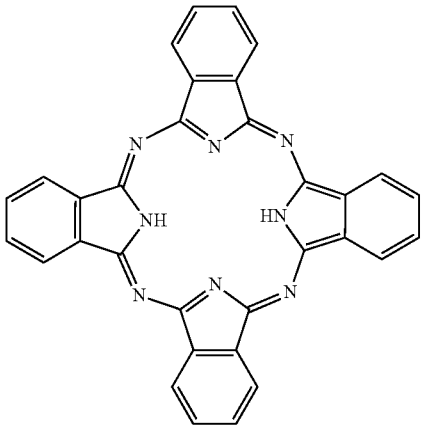

(CGM-2)

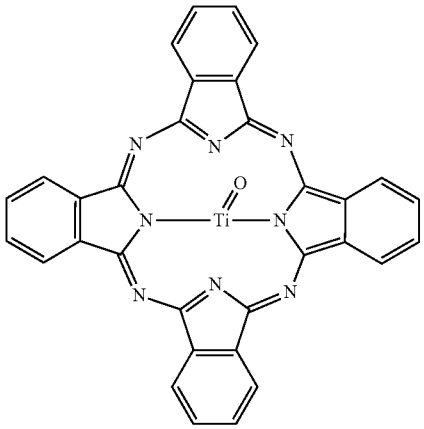

An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanine having an α-form crystal structure, a β-form crystal structure, or a Y-form crystal structure. The charge generating material is preferably metal-free phthalocyanine.

A charge generating material having an absorption wavelength in a desired range may be used independently, or two or more charge generating materials may be used in combination. Examples of a digital optical image forming apparatus include a laser beam printer or facsimile machine using a light source such as a semiconductor laser. In a digital optical image forming apparatus, a photosensitive member 1 that is sensitive to a region of wavelengths of 700 nm or longer is preferably used. For that reason, phthalocyanine pigments are preferable. A charge generating material may be used independently, or two or more charge generating materials may be used in combination.

The amount of the charge generating material is preferably at least 0.1 parts by mass and no greater than 50 parts by mass relative to 100 parts by mass of the binder resin, and more preferably at least 0.5 parts by mass and no greater than 30 parts by mass.

(Hole Transport Material)

Examples of the hole transport material include triphenylamine derivatives; diamine derivatives (specific examples include N,N,N',N'-tetraphenylbenzidine derivatives, N,N,N',N'-tetraphenyl-p-terphenylenediamine derivatives, N,N,N',N'-tetraphenylphenylenediamine derivatives, N,N,N',N'-tetraphenylnaphthylenediamine derivatives, di(aminophenylethenyl)benzene derivatives, and N,N,N',N'-tetraphenylphenanthrylenediamine derivatives); oxadiazole-based compounds (specific examples include 2,5-di(4-methylaminophenyl)-1,3,4-oxadiazole); styryl-based compounds (specific examples include 9-(4-diethylaminostyryl)anthracene); carbazole-based compounds (specific examples include polyvinyl carbazole); organic polysilane compounds; pyrazoline-based compounds (specific examples include 1-phenyl-3-(p-dimethylaminophenyl)pyrazoline); hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds. One of the hole transport materials listed above may be used independently, or two or more hole transport materials listed above may be used in combination. Among the hole transport materials, a hole transport material represented by general formula (HTM) is more preferable.

(HTM)

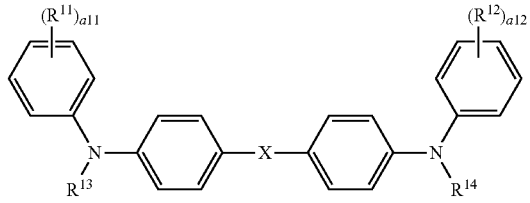

In general formula (HTM), $R^{11}$ and $R^{12}$ each represent, independently of each other, an alkyl group having a carbon number of at least 1 and no greater than 6 or an alkoxy group having a carbon number of at least 1 and no greater than 6. a11 and a12 each represent, independently of each other, an integer of at least 0 and no greater than 5. When a11 represents an integer of at least 2 and no greater than 5, groups represented by $R^{11}$ may be the same as or different from each other. When a12 represents an integer of at least 2 and no greater than 5, groups represented by $R^{12}$ may be the same as or different from each other. $R^{13}$ and $R^{14}$ each represent, independently of each other, a phenyl group or a diphenylethenyl group. The phenyl group and the diphenylethenyl group may each have an alkyl group having a carbon number of at least 1 and no greater than 6 or an alkoxy group having a carbon number of at least 1 and no greater than 6. At least one of $R^{11}$, $R^{12}$, $R^{13}$, and $R^{14}$ has an alkyl group having a carbon number of at least 1 and no greater than 6 or an alkoxy group having a carbon number of at least 1 and no greater than 6. X represents a single bond or a p-phenylene group.

In general formula (HTM), the alkyl group having a carbon number of at least 1 and no greater than 6 represented by $R^{11}$ or $R^{12}$ is preferably an alkyl group having a carbon number of at least 1 and no greater than 3, and more preferably a methyl group. The alkoxy group having a carbon number of at least 1 and no greater than 6 represented by $R^{11}$ or $R^{12}$ is preferably an alkoxy group having a carbon number of at least 1 and no greater than 3, and more preferably a methoxy group. a11 and a12 each preferably represent 1.

In general formula (HTM), it is preferable that $R^{11}$ and $R^{12}$ represent an alkyl group having a carbon number of at least 1 and no greater than 3 or an alkoxy group having a carbon number of at least 1 and no greater than 3, a11 and a12 each represent 1, and $R^{13}$ and $R^{14}$ each represent a phenyl group.

Examples of the compound represented by general formula (HTM) include a compounds represented by chemical formula (HTM-1), (HTM-2), and (HTM-3) (also referred to below as hole transport materials (HTM-1), (HTM-2), and (HTM-3), respectively).

(HTM-1)

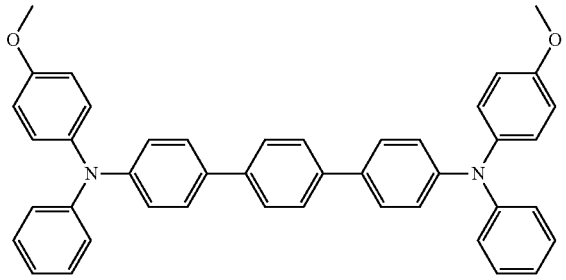

(HTM-2)

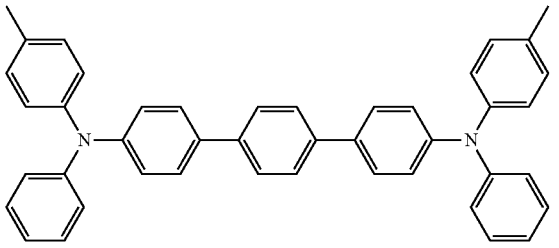

(HTM-3)

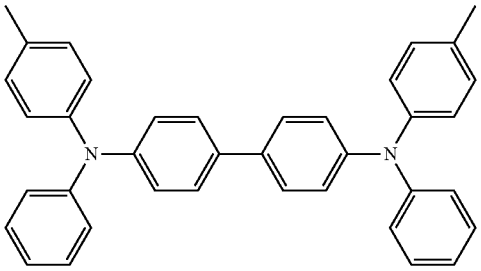

The total amount of the hole transport materials is preferably at least 10 parts by mass and no greater than 200 parts by mass relative to 100 parts by mass of the binder resin, and more preferably at least 10 parts by mass and no greater than 100 parts by mass.

(Electron Transport Material)

Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. One of the electron transport materials listed above may be used independently, or two or more electron transport materials listed above may be used in combination. Among the electron transport materials listed above, an electron transport material represented by general formula (ETM1), (ETM2), or (ETM3) is preferable.

(ETM1)

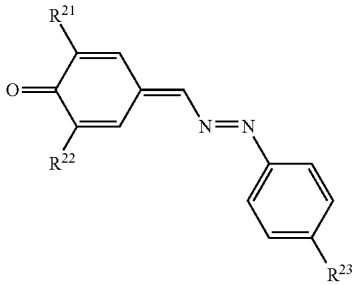

(ETM2)

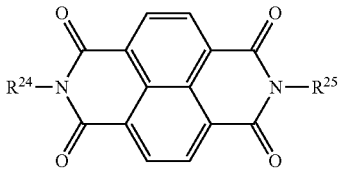

(ETM3)

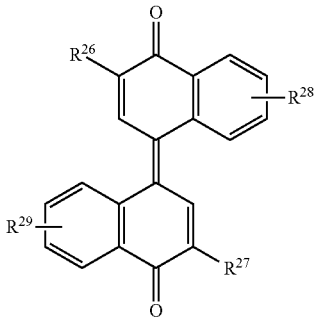

In general formula (ETM1), $R^{21}$ and $R^{22}$ represent an alkyl group having a carbon number of at least 1 and no greater than 6. $R^{23}$ represents a halogen atom.

In general formula (ETM2), $R^{24}$ and $R^{25}$ represent an aryl group having a carbon number of at least 6 and no greater than 14 and optionally having at least one alkyl group (that is, one or more alkyl groups) having a carbon number of at least 1 and no greater than 3.

In general formula (ETM3), $R^{26}$, $R^{27}$, $R^{28}$, and $R^{29}$ each represent, independently of one another, a hydrogen atom or an alkyl group having a carbon number of at least 1 and no greater than 6.

In general formula (ETM1), the alkyl group having a carbon number of at least 1 and no greater than 6 and being represented by $R^{21}$ or $R^{22}$ is preferably an alkyl group having a carbon number of at least 1 and no greater than 4, and more preferably a t-butyl group. The halogen atom represented by $R^{23}$ is preferably a chlorine atom. In general formula (ETM1), it is preferable that $R^{21}$ or $R^{22}$ each represent an alkyl group having a carbon number of at least 1 and no greater than 4 and $R^{23}$ represents a chlorine atom.

In general formula (ETM2), the aryl groups each having a carbon number of at least 6 and no greater than 14, optionally having at least one alkyl group (that is, one or more alkyl groups) having a carbon number of at least 1 and no greater than 3 and being represented by $R^{24}$ and $R^{25}$ are each preferably a phenyl group having at least one and no greater than three (for example, two) alkyl groups having a carbon number of at least 1 and no greater than 3, more preferably an ethylmethylphenyl group, and further more preferably a 2-ethyl-6-methylphenyl group. In general formula (ETM2), $R^{24}$ and $R^{25}$ each preferably represent a phenyl group having more than one (for example, two) alkyl groups having a carbon number of at least 1 and no greater than 3.

In general formula (ETM3), the alkyl group having a carbon number of at least 1 and no greater than 6 and being represented by $R^{26}$ or $R^{27}$ is preferably an alkyl group having a carbon number of at least 1 and no greater than 5, and more preferably a 1,1-dimethylpropyl group. In general formula (ETM3), it is preferable that $R^{26}$ and $R^{27}$ each represent an alkyl group having a carbon number of at least 1 and no greater than 5 and $R^{28}$ and $R^{29}$ each represent a hydrogen atom.

Examples of the compounds represented by general formulas (ETM1), (ETM2) and (ETM3) include compounds represented by chemical formulas (ETM1-1), (ETM2-1), and (ETM3-1) (also referred to below as electron transport materials (ETM1-1), (ETM2-1), and (ETM3-1), respectively).

(ETM1-1)

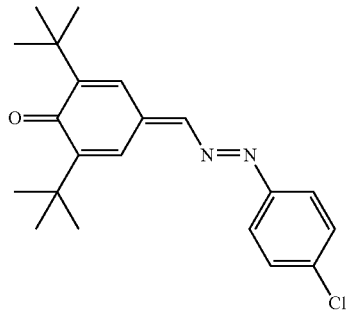

-continued (ETM2-1)

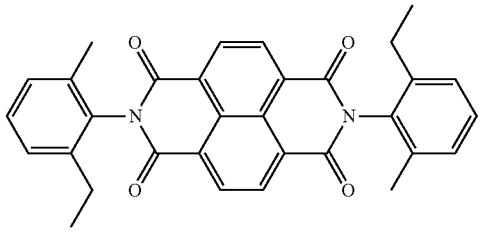

(ETM3-1)

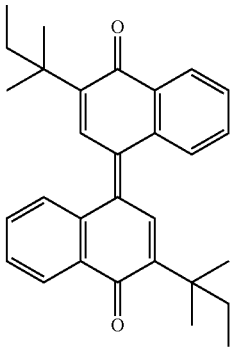

The amount of the electron transport material is preferably at least 5 parts by mass and no greater than 100 parts by mass relative to 100 parts by mass of the binder resin, and more preferably at least 10 parts by mass and no greater than 80 parts by mass.

(Binder Resin)

Examples of the binder resin include thermoplastic resins, thermosetting resins, and photocurable resins. Examples of the thermoplastic resins include polyester resins, polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, and polyether resins. Examples of the thermosetting resins include silicone resins, epoxy resins, phenolic resins, urea resins, melamine resins, and other cross-linkable thermosetting resins. Examples of the photocurable resins include epoxy-acrylic acid-based resins and urethane-acrylic acid copolymers. One of these resins listed above may be used independently, or two or more of the resins listed above may be used in combination.

Among these binder resins, in terms of further improving toner image transferring performance and sensitivity characteristics, a polyarylate resin represented by general formula (R) (also referred to below as polyarylate resin (R)) is preferred.

(R)

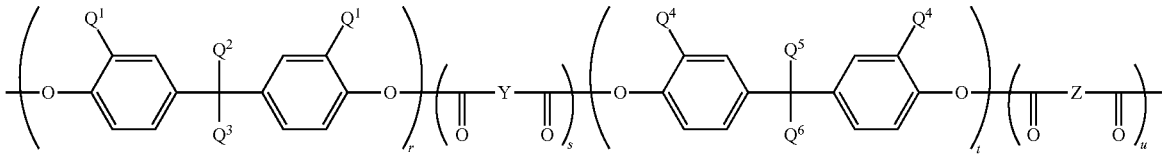

In general formula (R), $Q^1$ and $Q^4$ each represent, independently of each other, a hydrogen atom or a methyl group. $Q^2$, $Q^3$, $Q^5$, and $Q^6$ each represent, independently of one another, a hydrogen atom or an alkyl group having a carbon number of at least 1 and no greater than 4. $Q^2$ and $Q^3$ are different from each other. $Q^2$ and $Q^3$ may be bonded to each other to form a ring. $Q^5$ and $Q^6$ are different from each other. $Q^5$ and $Q^6$ may be bonded to each other to form a ring. r, s, t, and u each represent a number (for example, an integer) of at least 1 and no greater than 50. r+s+t+u=100 is satisfied. r+t=s+u is satisfied. Y and Z are each represented, independently of each other, by chemical formula (1R), (2R), or (3R).

(1R)

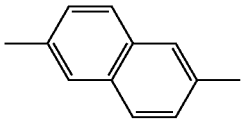

(2R)

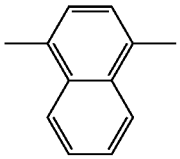

(3R)

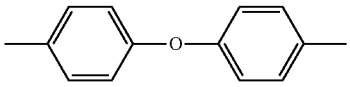

When $Q^2$ and $Q^3$ are bonded to each other to form a ring, $Q^2$ and $Q^3$ are preferably bonded to each other to form a divalent group represented by general formula (W). When $Q^5$ and $Q^6$ are bonded to each other to form a ring, $Q^5$ and $Q^6$ are preferably bonded to each other to form a divalent group represented by general formula (W).

(W)

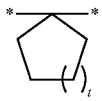

In general formula (X), t represents an integer of at least 1 and no greater than 3. t preferably represents 2. * represents a bond.

Examples of the ring formed by $Q^2$ and $Q^3$ bonded to each other and the ring formed by $Q^5$ and $Q^6$ bonded to each other include a cycloalkyl ring having a carbon number of at least 5 and no greater than 7 (more preferably, a cyclohexane ring).

r represents a percentage of the number of the repeating units to which r is attached to the total number of repeating units in the polyarylate resin (R) (unit: mol %). s represents a percentage of the number of the repeating units to which s is attached to the total number of the repeating units in the polyarylate resin (R) (unit: mol %). t represents a percentage of the number of the repeating units to which t is attached to the total number of the repeating units in the polyarylate resin (R) (unit: mol %). u represents a percentage of the number of the repeating units to which u is attached to the total number of the repeating units in the polyarylate resin (R) (unit: mol %). r, s, t, and u each represent preferably a number of at least 1 and no greater than 49, more preferably a number of at least 20 and no greater than 30, and further more preferably 25.

No particular limitations are placed on a sequence of repeating units in the polyarylate resin (R), and the polyarylate resin (PA) may be any of a random copolymer, a block copolymer, a periodic copolymer, and an alternating copolymer.

Preferable examples of the polyarylate resin (R) include first, second, third, and fourth polyarylate resins. The first polyarylate resin is a polyarylate resin where in general formula (R), $Q^1$ and $Q^4$ each represent a methyl group, $Q^2$ and $Q^3$ are bonded to each other to form a divalent group represented by general formula (W), $Q^5$ and $Q^6$ are bonded to each other to form a divalent group represented by general formula (W), Y is represented by chemical formula (1R), Z is represented by chemical formula (3R), and t in general formula (W) represents 2. The second polyarylate resin is a polyarylate resin where in general formula (R), $Q^1$ and $Q^4$ each represent a methyl group, $Q^2$ and $Q^3$ are bonded to each other to form a divalent group represented by general formula (W), $Q^5$ and $Q^6$ are bonded to each other to form a divalent group represented by general formula (W), Y is represented by chemical formula (1R), Z is represented by chemical formula (2R), and tin general formula (W) represents 2. The third polyarylate resin is a polyarylate resin where in general formula (R), $Q^1$ and $Q^4$ each represent a methyl group, $Q^2$ represents a hydrogen atom, $Q^3$ represents a methyl group, $Q^5$ and $Q^6$ are bonded to each other to form a divalent group represented by general formula (W), Y is represented by chemical formula (1R), Z is represented by chemical formula (3R), and t in general formula (W) represents 2. The fourth polyarylate resin is a polyarylate resin where in general formula (R), $Q^1$ and $Q^4$ each represent a methyl group, $Q^2$ represents a hydrogen atom, $Q^3$ represents a methyl group, $Q^5$ represents a hydrogen atom, $Q^6$ represent a methyl group, Y is represented by chemical formula (1R), and Z is represented by chemical formula (2R).

More preferred examples of the polyarylate resin (R) include polyarylate resins represented by chemical formulas (R-1), (R-2), (R-3), and (R-4) (also referred to below as polyarylate resins (R-1), (R-2), (R-3), and (R-4), respectively).

(R-1)

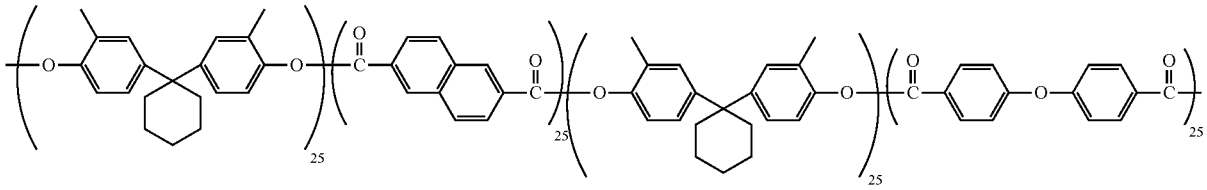

(R-2)

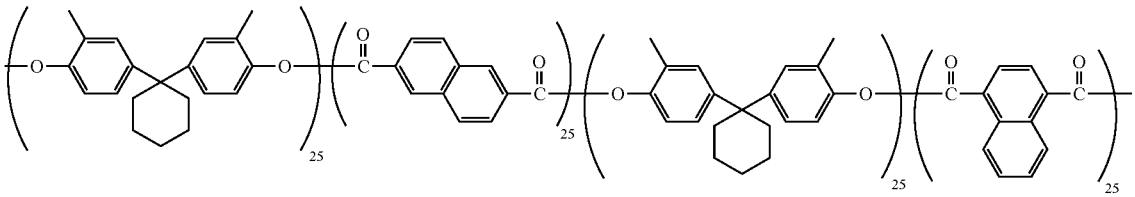

(R-3)

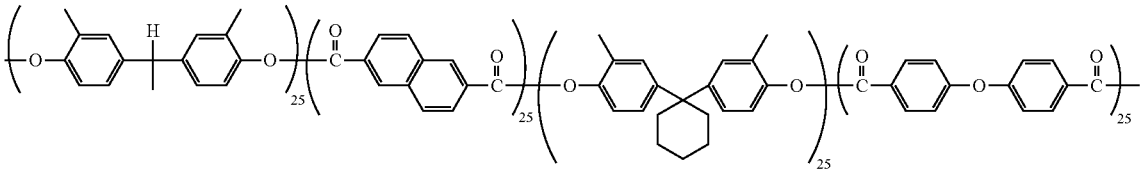

(R-4)

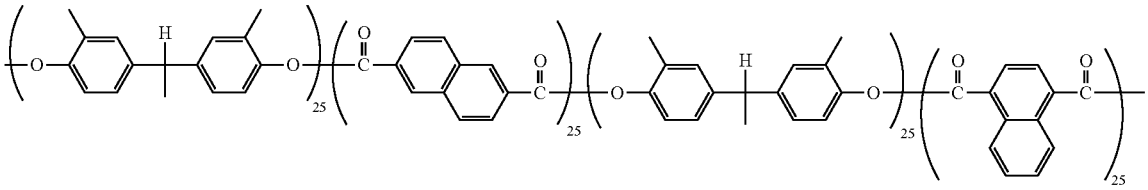

The binder resin has a viscosity average molecular weight of preferably at least 40,000, and more preferably at least 40,000 and no greater than 52,500. As a result of the binder resin having a viscosity average molecular weight of at least 40,000, abrasion resistance of the photosensitive member 1 can easily be improved. In addition, as a result of the binder resin having a viscosity average molecular weight of no greater than 52,500, the binder resin is easy to dissolve in a solvent. Thus, excessive increase in viscosity of an application liquid for photosensitive layer formation is prevented. Thus, formation of the photosensitive layer 3 can be facilitated.

(Combination of Materials)

In order to improve toner transferring performance and sensitivity characteristics, a combination of the binder resin, the electron transport material, and the hole transport material in the photosensitive layer 3 is preferably any of combination examples (F-1) to (F-8) shown in Table 1. It is more preferable that the combination of the binder resin, the electron transport material, and the hole transport material in the photosensitive layer 3 is any of combination examples (F-1) to (F-8) shown in Table 1 and the charge generating material is X-form metal-free phthalocyanine.

TABLE 1

| Combination example | Resin | ETM | HTM |
|---|---|---|---|
| F-1 | R-1 | ETM1-1 | HTM-1 |
| F-2 | R-2 | ETM1-1 | HTM-1 |
| F-3 | R-3 | ETM1-1 | HTM-1 |
| F-4 | R-4 | ETM1-1 | HTM-1 |
| F-5 | R-1 | ETM2-1 | HTM-1 |
| F-6 | R-1 | ETM3-1 | HTM-1 |
| F-7 | R-1 | ETM1-1 | HTM-2 |
| F-8 | R-1 | ETM1-1 | HTM-3 |

In order to improve toner transferring performance and sensitivity characteristics, a combination of the binder resin, the electron transport material, the hole transport material, the content percentage of the phthalocyanine pigment relative to the mass of the photosensitive layer 3, and the film thickness in the photosensitive layer 3 is any of combination examples (G-1) to (G-13) shown in Table 2. It is more preferable that the photosensitive layer 3 has the binder resin, the electron transport material, the hole transport material, the content percentage of the phthalocyanine pigment relative to the mass of the photosensitive layer 3, and the film thickness in any of combination examples (G-1) to (G-13) shown in Table 2, and the charge generating material is X-form metal-free phthalocyanine.

TABLE 2

| Combination example | Resin | ETM | HTM | CGM content (% by mass) | Film thickness (μm) |
|---|---|---|---|---|---|
| G-1 | R-1 | ETM1-1 | HTM-1 | 0.70 ≤ content < 0.80 | 27 ≤ thickness ≤ 30 |
| G-2 | R-1 | ETM1-1 | HTM-1 | 0.80 ≤ content ≤ 1.00 | 27 ≤ thickness ≤ 30 |
| G-3 | R-1 | ETM1-1 | HTM-1 | 1.00 < content ≤ 1.20 | 27 ≤ thickness ≤ 30 |
| G-4 | R-1 | ETM1-1 | HTM-1 | 1.20 < content ≤ 1.40 | 27 ≤ thickness ≤ 30 |
| G-5 | R-2 | ETM1-1 | HTM-1 | 0.80 ≤ content ≤ 1.00 | 27 ≤ thickness ≤ 30 |
| G-6 | R-3 | ETM1-1 | HTM-1 | 0.80 ≤ content ≤ 1.00 | 27 ≤ thickness ≤ 30 |
| G-7 | R-4 | ETM1-1 | HTM-1 | 0.80 ≤ content ≤ 1.00 | 27 ≤ thickness ≤ 30 |
| G-8 | R-1 | ETM1-1 | HTM-1 | 0.80 ≤ content ≤ 1.00 | 25 ≤ thickness < 27 |
| G-9 | R-1 | ETM1-1 | HTM-1 | 0.80 ≤ content ≤ 1.00 | 30 < thickness ≤ 32 |
| G-10 | R-1 | ETM2-1 | HTM-1 | 0.80 ≤ content ≤ 1.00 | 27 ≤ thickness ≤ 30 |
| G-11 | R-1 | ETM3-1 | HTM-1 | 0.80 ≤ content ≤ 1.00 | 27 ≤ thickness ≤ 30 |
| G-12 | R-1 | ETM1-1 | HTM-2 | 0.80 ≤ content ≤ 1.00 | 27 ≤ thickness ≤ 30 |
| G-13 | R-1 | ETM1-1 | HTM-3 | 0.80 ≤ content ≤ 1.00 | 27 ≤ thickness ≤ 30 |

In order to improve toner transferring performance and sensitivity characteristics, it is preferable that the content percentage of a phthalocyanine pigment being the charge generating material is at least 0.70% by mass and no greater than 1.00% by mass relative to the mass of the photosensitive layer 3, the film thickness of the photosensitive layer 3 is at least 27 μm and not greater than 32 μm, the charge amount difference ΔQ of the surface of the photosensitive layer is at least 4.00 μC and no greater than 6.20 μC, the hole transport material is the hole transport material (HTM-1), (HTM-2), or (HTM-3), the electron transport material is the electron transport material (ETM1-1), (ETM2-1), or (ETM3-1), and the binder resin is the polyarylate resin (R-1), (R-2), (R-3), or (R-4).

(Additive)

Examples of additives include antidegradants (specific examples include antioxidants, radical scavengers, quenchers, and ultraviolet absorbing agents), softeners, surface modifiers, extenders, thickeners, dispersion stabilizers, waxes, acceptors, donors, surfactants, plasticizers, sensitizers, and leveling agents.

[Intermediate Layer]

The intermediate layer 4 (particularly, undercoat layer) is located between the conductive substrate 2 and the photosensitive layer 3 in the photosensitive layer 3, for example. The intermediate layer 4 for example contains inorganic particles and a resin (intermediate layer resin). Provision of the intermediate layer 4 can maintain insulation to a sufficient degree for preventing occurrence of leakage current. Provision of the intermediate layer 4 can also facilitate flow of current generated when the photosensitive member 1 is exposed to light and inhibit increasing resistance.

Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of inorganic particles listed above may be used independently, or any two or more types of organic particles listed above may be used in combination.

No particular limitations are placed on the intermediate layer resin as long as being usable as a resin forming the intermediate layer 4.

The intermediate layer 4 may contain various additives within a range where electrophotographic characteristics of the photosensitive member 1 is not adversely affected. Examples of the additive in the intermediate layer 4 are the same as those of the additive in the photosensitive layer 3.

(Photosensitive Member Production Method)

The following describes a production method of the photosensitive member 1 with reference to FIGS. 1A to 1C. The production method of the photosensitive member 1 includes photosensitive layer formation process. The following describes the photosensitive layer formation process.

(Photosensitive Layer Formation Process)

In the photosensitive layer formation process, an application liquid for forming a photosensitive layer (also referred to below as an application liquid) is applied onto a conductive substrate 2 to form a liquid film. At least a portion of a solvent contained in the liquid film is removed to form a photosensitive layer 3. The photosensitive layer formation process includes for example an application liquid preparation process, an application process, and a drying process. The following describes the application liquid preparation process, the application process, and the drying process.

(Application Liquid Preparation Process)

In the application liquid preparation process, an application liquid is prepared. The application liquid contains at least a charge generating material, a hole transport material, an electron transport material, and a binder resin. The application liquid may contain an additive as necessary. The application liquid can be prepared by dissolving or dispersing in a solvent the charge generating material, the hole transport material, the electron transport material, the binder resin, and an optional component.

No particular limitations are placed on the solvent contained in the application liquid as long as components of the application liquid are soluble or dispersible in the solvent. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, N,N-dimethyl formamide (DMF), and dimethyl sulfoxide. Any one of the solvents listed above may be used independently, or any two or more of the solvents listed above may be used in combination. Among these solvents, a non-halogen solvent is preferable.

The application liquid is prepared by mixing the components to dissolve or disperse the components in the solvent. Mixing or dispersion can for example be performed using a bead mill, a roll mill, a ball mill, an attritor, a paint shaker, or an ultrasonic disperser.

The application liquid may contain for example a surfactant or a leveling agent in order to increase dispersibility of the components or improve surface flatness of formed layers.

(Application Process)

In the application process, the application liquid is applied onto a conductive substrate 2 to form a liquid film. No particular limitations are placed on a method for applying the application liquid as long as the method enables uniform application of the application liquid onto the conductive substrate 2. Examples of the application method include dip coating, spray coating, spin coating, and bar coating.

In terms of easy adjustment of the thickness of the photosensitive layer 3 to a desired value, the dip coating is preferable as the method for applying the application liquid. In a case where the application process is performed by the dip coating, the conductive substrate 2 is dipped in the application liquid in the application process. Subsequently, the dipped conductive substrate 2 is pulled out of the application liquid. In this way, the application liquid is applied onto the conductive substrate 2.

(Drying Process)

In the drying process, at least a portion of the solvent contained in the liquid film is removed. No particular limitations are placed on a method for removing at least a portion of the solvent contained in the liquid film as long as the method enables evaporation of the solvent in the application liquid. Examples of the method for removal include heating, pressure reduction, and a combination of heating and pressure reduction. More specific examples include a method that involves heat treatment (hot-air drying) using a high-temperature dryer or a reduced pressure dryer. The heat treatment is for example performed at a temperature of 40° C. or higher and 150° C. or lower for 3 minutes or longer and 120 minutes or shorter.

The production method of the photosensitive member 1 may further include either or both a formation process of an intermediate layer 4 and a formation process of a protective layer 5 as needed. Any known method can be selected as appropriate for the formation process of the intermediate layer 4 and the formation process of the protective layer 5.

Second Embodiment: Image Forming Apparatus

Figure 3:
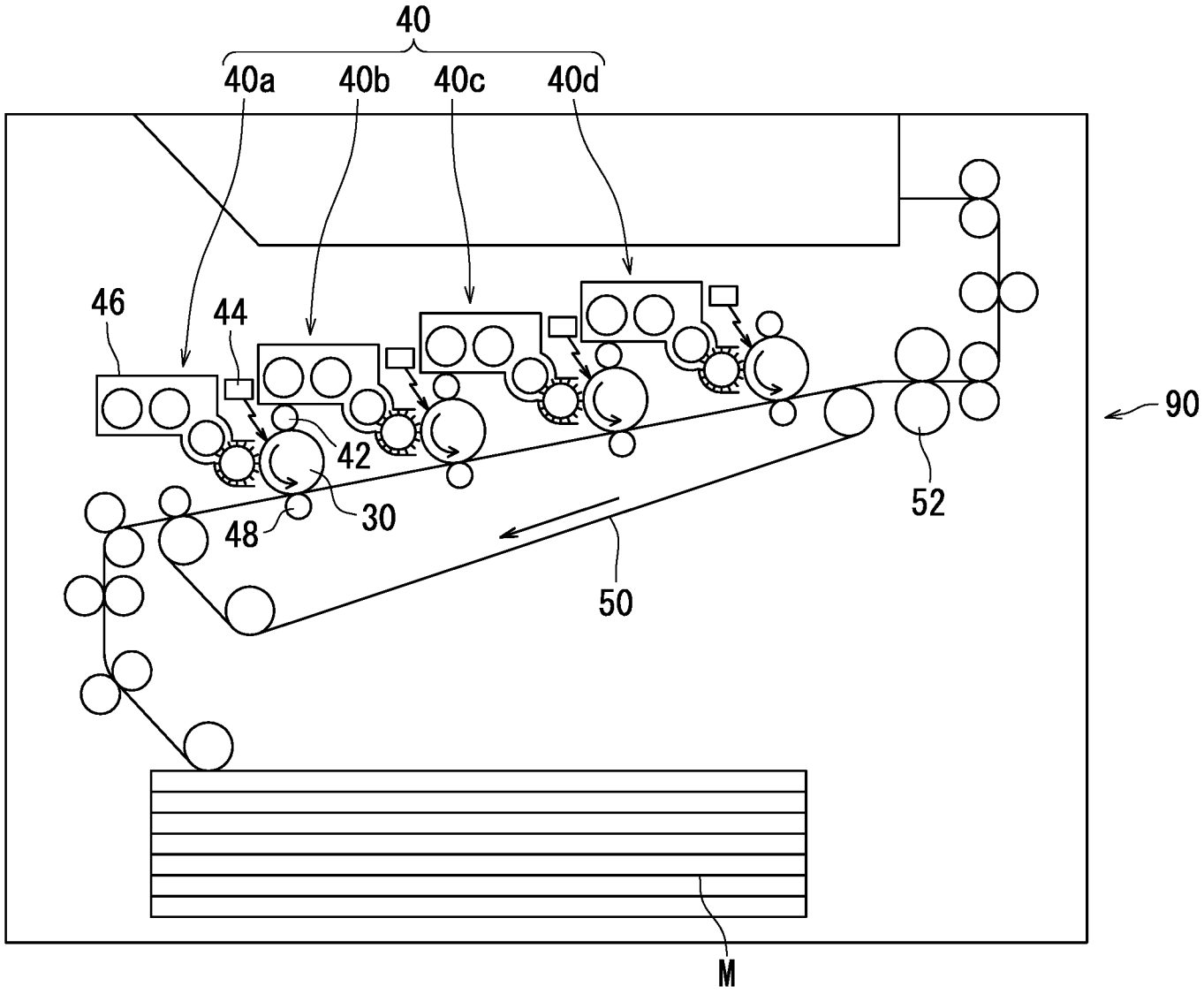
FIG. 3 is a schismatic view illustrating an image forming apparatus according to a second embodiment.

The following describes an aspect of an image forming apparatus according to the second embodiment with reference to FIG. 3. FIG. 3 is a view illustrating an example of an image forming apparatus 90 according to the second embodiment. The image forming apparatus 90 according to the second embodiment includes an image forming unit 40. The image forming unit 40 includes image bearing members 30, chargers 42, light exposure sections 44, developing sections 46, and transfer sections 48. The image bearing members 30 are each the photosensitive member 1 according to the first embodiment. The chargers 42 each charge a surface of a corresponding one of the image bearing members 30. The chargers 42 have a positive charging polarity. The light exposure sections 44 each form an electrostatic latent image on the charged surface of a corresponding one of the image bearing members 30 by exposing the surfaces of the image bearing members 30 to light. The developing section 46 develops the electrostatic latent images into a toner images. The transfer section 48 transfers the toner images from the surfaces of the image bearing members 30 to a recording medium M. An outline of the image forming apparatus 90 according to the second embodiment has been described so far.

The image forming apparatus 90 according to the second embodiment can form an image excellent in toner image transferring performance. Presumably, the reason therefor is as follows. As described in the first embodiment, the photosensitive member 1 according to the first embodiment is excellent in toner image transferring performance. Therefore, as a result of including the photosensitive member 1 according to the first embodiment as the image bearing member 30, the image forming apparatus 90 according to the second embodiment is excellent in toner image transferring performance.

The following describes each section of the image forming apparatus 90 according to the second embodiment in detail. No particular limitations are placed on the image forming apparatus 90 as long as the apparatus is an electrophotographic image forming apparatus. The image forming apparatus 90 may for example be a monochrome image forming apparatus or a color image forming apparatus. In a case where the image forming apparatus 90 is a color image forming apparatus, the image forming apparatus 90 employs for example a tandem system. The following describes a tandem image forming apparatus 90 as an example.

The image forming apparatus 90 employs a direct transfer process. Usually, an image forming apparatus employing a direct transfer process readily degradates in toner image transferring performance, and accordingly, an image defect resulting from degradation in the transferring performance tends to be caused. However, the image forming apparatus 90 according to the second embodiment includes the photosensitive member 1 according to the first embodiment as each image bearing member 30. The photosensitive member 1 according to the first embodiment is excellent in toner image transferring performance. Therefore, as a result of the image forming apparatus 90 according to the second embodiment including the photosensitive member 1 according to the first embodiment as the image bearing member 30, occurrence of an image defect due to degradation in toner image transferring performance is thought to be reduced even when a direct transfer process is employed.

The image forming apparatus 90 further includes a conveyor belt 50 and a fixing section 52.

The image forming unit 40 forms an image. The image forming unit 40 may include image forming units 40*a*, 40*b*, 40*c*, and 40*d* for each color. The image forming units 40*a* to 40*d* sequentially superimpose toner images of different colors (for example, four colors of black, cyan, magenta, and yellow) on a recording medium M placed on the conveyor belt 50. Note that in a case where the image forming apparatus 90 is a monochrome image forming apparatus, the image forming apparatus 90 includes an image forming unit 40*a* and the image forming units 40*b* to 40*d* are omitted.

The image forming unit 40 may further include cleaners (not illustrated). Examples of each cleaner include a cleaning blade. The image bearing members 30 are disposed at a central position in the image forming unit 40. The image bearing members 30 are disposed in a rotatable manner in respective directions indicated by arrows (counterclockwise). Around each of the image bearing members 30, the charger 42, the light exposure section 44, the developing section 46, and the transfer section 48 are disposed in the stated order from upstream in a rotation direction of the image bearing member 30 starting from the charger 42 as a reference. Note that the image forming unit 40 may further include static eliminating sections (not illustrated).

Each charger 42 is a charging roller. The charging roller charges a surface of the image bearing member 30 while in contact with the surface of the image bearing member 30. No particular limitations are placed on the voltage applied by the charger 42. Examples of the voltage applied by the charger 42 include a DC voltage, an AC voltage, or a superimposed voltage (a voltage in which an AC voltage is superimposed on a DC voltage), and more preferably a DC voltage. A DC voltage has the following advantages over an AC voltage or a superimposed voltage. When the charger 42 applies only a DC voltage, a value of the voltage applied to the image bearing member 30 is constant, so that the surface of the image bearing member 30 is easily and uniformly charged to a specific potential. In addition, when the charger 42 applies only a DC voltage, the abrasion amount of the photosensitive layer 3 tends to decrease. As a result, favorable images can be formed.

The light exposure sections 44 irradiate the charged surface of a corresponding one of the image bearing members 30. As a result, electrostatic latent images are formed on the surfaces of the respective image bearing members 30. The electrostatic latent images are formed based on image data input to the image forming apparatus 90.

The developing sections 46 develop the respective electrostatic latent image into toner images. In addition, the developing sections 46 are each configured to clean the surface of corresponding one of the image bearing members 30. That is, the image forming apparatus 90 according to the second embodiment can employ a blade cleanerless system. Usually, an image forming apparatus employing a blade cleanerless system tends to suffer from degradation in toner image transferring performance, and accordingly, an image defect resulting from degradation in the transferring performance tends to be caused. However, the image forming apparatus 90 according to the second embodiment includes the photosensitive member 1 according to the first embodiment as each image bearing member 30. Therefore, in the image forming apparatus 90 according to the second embodiment, occurrence of an image defect due to degradation in toner image transferring performance can be reduced even when a blade cleanerless system is employed.

In order for each developing section 46 to efficiently clean the surface of a corresponding one of the image bearing members 30, it is preferable that the following conditions (1) and (2) are satisfied.

Condition (1): A contact developing process is employed, and a peripheral speed difference is provided between the image bearing member 30 and a development roller.

Condition (2): The difference between the surface potential of the image bearing member 30 and the potential of the development bias satisfies the following mathematical expressions (2-1) and (2-2).

0 (V)<potential of development bias (V)<surface potential of non-exposed region of image bearing member 30 (V) mathematical expression (2-1)

potential of development bias (V)>surface potential of exposed region of image bearing member 30 (V)>0 (V) mathematical expression (2-2)

In mathematical expression (2-1), surface potential of non-exposed region of image bearing member 30 (V) is a surface potential of a region of the image bearing member 30 not having been exposed by the light exposure section 44. In mathematical expression (2-2), surface potential of exposed region of image bearing member 30 (V) is a surface potential of a region of the image bearing member 30 having been exposed by the light exposure section 44. Note that the surface potential of the non-exposed region and the surface potential of the exposed region of the image bearing member 30 are measured after the transfer section 48 transfers a toner image from the image bearing member 30 to the recording medium M before the charger 42 charges the surface of the image bearing member 30 for the next rotation.

When the contact developing process is employed and a peripheral speed difference is provided between the image bearing member 30 and a development roller as described in condition (1), the surface of the image bearing member 30 comes into contact with the development roller, and residual components on the surface of the image bearing member 30 are removed by friction with the developing roller. The image forming apparatus 90 according to the second embodiment can employ the contact developing process. In the image forming apparatus 90 that employs the contact developing process, the developing sections 46 develop the respective electrostatic latent image into toner images while in contact with the surfaces of the image bearing members 30.

The rotational speed of the image bearing member 30 is preferably at least 120 mm/sec and no greater than 350 mm/sec. The rotational speed of the development roller is preferably at least 133 mm/sec and no greater than 700 mm/sec. Further, the ratio between the rotational speed $V_P$ of the image bearing member 30 and the rotational speed $V_D$ of the developing roller preferably satisfies mathematical expression (1-1). When this ratio is other than 1, it indicates that a peripheral speed difference is provided between the image bearing member 30 and a development roller.

$0.5 \leq V_P/V_D \leq 0.8$ mathematical expression (1-1)

Condition (2) is described using an example in which toner has a positive charging polarity and the developing process is a reversal development process. When a difference is provided between the potential of the development bias and the surface potential of the image bearing member 30 as described in condition (2), the surface potential (charge potential) of the image bearing member 30 and the potential of the development bias satisfies mathematical expression (2-1) in the non-exposed region, and therefore, an electrostatic repulsive force acting between remaining toner (also referred to below as residual toner) and the non-exposed region of the image bearing member 30 is greater than an electrostatic force acting between the residual toner and the development roller. Therefore, the residual toner moves from the surface of the image bearing member 30 to the development roller and is then collected. It is difficult for the toner to adhere to the non-exposed region of the image bearing member 30.

When a difference is provided between the potential of the development bias and the surface potential of the image bearing member 30 as described in condition (2), the surface potential (post-exposure potential) of the image bearing member 30 and the potential of the development bias satisfies mathematical expression (2-2), in the exposed region and therefore, an electrostatic repulsive force acting between residual toner and the non-exposed region of the image bearing member 30 is smaller than an electrostatic force acting between the residual toner and the development roller. Therefore, the residual toner on the surface of the image bearing member 30 is held on the surface of the image bearing member 30. The toner adheres to the exposed region of the image bearing member 30.

The potential of the development bias is for example at least +250 V and no greater than +400 V. The charge potential of the image bearing member 30 is for example at least +450 V and no greater than +900 V. The post-exposure potential of the image bearing member 30 is for example at least +50 V and no greater than +200 V. The difference between the potential of the development bias and the charge potential of the image bearing member 30 is for example at least +100 V and no greater than +700 V. The difference between the potential of the development bias and the post-exposure potential of the image bearing member 30 is for example at least +150 V and no greater than +300 V. The potential difference as used herein is expressed in terms of an absolute value of the difference. A condition for providing such a potential difference is for example "the potential of the development bias being +330 V", "the charge potential of the image bearing member 30 being +600 V", or "the post-exposure potential of the image bearing member 30 being +100 V".

The transfer sections 48 are transfer rollers. The transfer rollers transfer the toner images developed by the developing sections 46 from the surfaces of the respective image bearing members 30 to the recording medium M. In transfer of the toner images from the image bearing members 30 to the recording medium M, the image bearing members 30 are in contact with the recording medium M.

The conveyor belt 50 conveys the recording medium M so that the recording medium M passes between the image bearing members 30 and the transfer sections 48. The conveyor belt 50 is an endless belt. The conveyor belt 50 is disposed in a rotatable manner in a direction indicated by an arrow (clockwise).

The fixing section 52 fixes an unfixed toner images transferred onto the recording medium M by application of either or both heat and pressure. Through the above, an image is formed on the recording medium M. The fixing section 52 includes for example either or both a heating roller and a pressure roller.

Third Embodiment: Process Cartridge

The third embodiment relates to a process cartridge. A process cartridge according to the third embodiment includes the photosensitive member 1 according to the first embodiment. The following describes an example of the process cartridge according to the third embodiment with reference further to FIG. 3.

The process cartridge includes the image bearing member 30. In addition to the image bearing member 30, the process cartridge may further include at least one selected from the group consisting of the charger 42, the light exposure section 44, the developing section 46, and the transfer section 48. The process cartridge corresponds to for example each of the image forming units 40*a* to 40*d*. The process cartridge may further include a cleaner or a static eliminator (not illustrated). The process cartridge is designed to be freely attachable to and detachable from an image forming apparatus 90. Therefore, the process cartridge is easy to handle and can therefore be easily and quickly replaced, together with the image bearing member 30, when toner image transferring performance of the image bearing member 30 degrades.

EXAMPLES

The following provides more specific description of the present invention through use of Examples. However, the present invention is by no means limited to the scope of Examples.

[Materials of Photosensitive Member]

The following charge generating material, hole transport materials, electron transport materials, and binder resins were prepared as materials for forming photosensitive layers of photosensitive members.

A compound (CGM-1X) was prepared as a charge generating material. The compound (CGM-1X) was the metal-free phthalocyanine represented by chemical formula (CGM-1) described in the first embodiment. Furthermore, the crystal structure of the compound (CGM-1X) was X-form.

The hole transport materials (HTM-1) to (HTM-3) and electron transport materials (ETM1-1) to (ETM3-1) described in the first embodiment were prepared. In addition, compounds represented by the following chemical formulas (H-4) and (H-5) were prepared as hole transport materials used in Comparative Examples. Further, compounds represented by the following chemical formulas (E-4) and (E-5) were prepared as electron transport materials used in Comparative Examples.

(H-4)

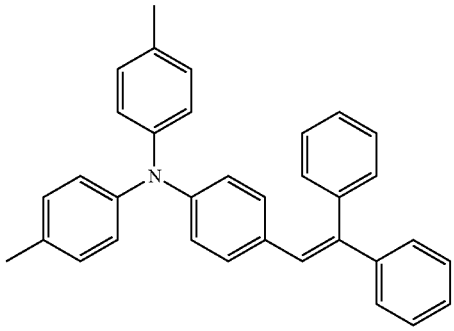

(H-5)

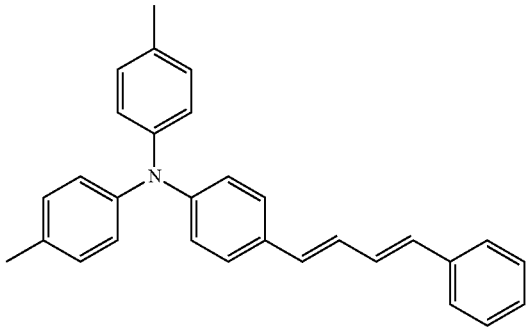

(E-4)

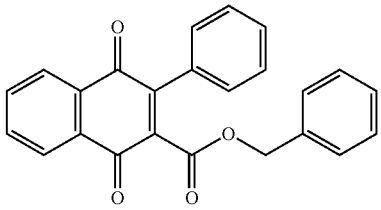

-continued (E-5)

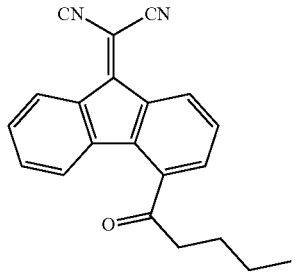

Polyarylate resins (R-1) to (R-4) described in the first embodiment were prepared as binder resins. Furthermore, a polycarbonate resin (R-5) was prepared as a binder resin used in Comparative Examples. The polycarbonate resin (R-5) was a polycarbonate resin represented by chemical formula (R-5). In chemical formula (R-5), "100" indicates that the polycarbonate resin (R-5) includes only the repeating unit shown in chemical formula (R-5).

(R-5)

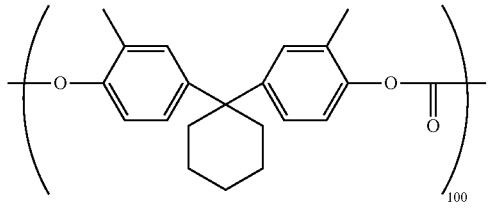

[Production of Photosensitive Members]

Photosensitive members (A-1) to (A-13) and (B-1) to (B-9) were produced using the prepared materials for forming photosensitive layers of photosensitive members.

(Production of Photosensitive Member (A-1))

An application liquid was prepared. A vessel was charged with 1.4 parts by mass of the compound (CGM-1X) as a charge generating material, 65 parts by mass of the hole transport material (HTM-1), 28 parts by mass of the electron transport material (ETM1-1), 100 parts by mass of the polyarylate resin (R-1) as a binder resin, and 800 parts by mass of tetrahydrofuran as a solvent. The vessel contents were mixed and dispersed using a ball mill for 50 hours to obtain an application liquid. The content percentage of the charge generating material was 5.67% by mass relative to the solid content (compound (CGM-1X), hole transport material (HTM-1), electron transport material (ETM1-1), and polyarylate resin (R-1)).

Next, the application liquid was applied onto a conductive substrate by dip coating to form a liquid film on the conductive substrate. Specifically, the conductive substrate was dipped in the application liquid. Subsequently, the dipped conductive substrate was pulled out of the application liquid. In this way, the application liquid was applied onto the conductive substrate to form a liquid film.

Next, the conductive substrate having the liquid film formed thereon was hot-air dried at 100° C. for 40 minutes. Through the above, the solvent (tetrahydrofuran) contained in the liquid film was removed. As a result, a photosensitive layer was formed on the conductive substrate. In this way, a photosensitive member (A-1) was obtained.

(Production of Photosensitive Members (A-2) to (A-13) and (B-1) to (B-9))

Each of the photosensitive members (A-2) to (A-13) and (B-1) to (B-9) was produced by the same method as the production method of the photosensitive member (A-1) in all aspects except the following changes.

The binder resin, the electron transport material, and the hole transport material used were changed from the polyarylate resin (R-1), the electron transport material (ETM1-1), and the hole transport material (HTM-1) used for the preparation of the application liquid in the production of the photosensitive member (A-1) to those shown in Table 3 or Table 4. Further, by changing the amount of the charge generating material, the content percentage of the charge generating material relative to the mass of the photosensitive layer was changed from 0.72% by mass to the content percentage shown in Table 3 or Table 4. Further, the film thickness of the photosensitive layer was changed from 28 μm in the production of the photosensitive member (A-1) to the film thickness shown in Table 3 or Table 4.

(Charge Amount Difference)

With respect to each of the photosensitive members (A-1) to (A-13) and (B-1) to (B-9), the charge amount difference of the photosensitive layer was calculated by the method described in the first embodiment.

(Evaluation of Toner Image Transferring Performance of Photosensitive Member)

With respect to each of the photosensitive members (A-1) to (A-13) and (B-1) to (B-9), the photosensitive member was mounted in an evaluation apparatus. As the evaluation apparatus, a printer ("FS-1300D", product of KYOCERA Document Solutions Inc., a dry electrophotographic image forming apparatus using a semiconductor laser) was used. The evaluation apparatus included a charging roller as the charger. To the charging roller, a DC voltage was applied. The evaluation apparatus included a transfer section (a transfer roller) employing a direct transfer process. The evaluation apparatus included a developing section employing a contact developing process. The evaluation apparatus did not include a cleaning blade. The developing section of the evaluation apparatus was configured to clean a surface of an image bearing member. As a sheet for evaluation of transferring performance, "Kyocera Document Solutions Brand Paper VM-A4 (A4 size)" marketed by Kyocera Document Solutions Inc. was used. As a toner for evaluation of transferring performance, "TK-131", product of KYOCERA Document Solutions Inc. was used. Measurement for evaluation of transferring performance was performed in a high temperature and high humidity environment (temperature of 32.5° C. and relative humidity of 80%).

An evaluation image was formed on a sheet of the paper using the toner and the evaluation apparatus including the photosensitive member mounted therein. Details of the evaluation image will be described later with reference to FIG. 4. The current applied to the photosensitive member by the transfer roller was set to −10 μA.

The obtained image was visually observed to determine the presence or absence of an image corresponding the image 208 in a region 204. Using a result obtained by visual observation, toner image transferring performance of the photosensitive member was evaluated based on the following evaluation criteria. Evaluation A (very good) and evaluation B (good) were regarded as acceptable. The evaluation results are shown in the column "transferring performance" in Tables 3 and 4.

An evaluation image will be described with reference to FIG. 4. FIG. 4 is a diagram illustrating an evaluation image.

The evaluation image 200 includes a region 202 and a region 204. The region 202 corresponds to one rotation of the image bearing member. The image 208 in the region 202 includes images 208L, 208C, and 208R. The image 208 includes only solid images (image density: 100%). The solid images each had a square (10 mm square) shape. The region 204 corresponds to one rotation of the photosensitive member and includes an entirely white image (image density: 0%). In the conveyance direction a, the image 208 of the region 202 was formed first and then a white image of the region 204 was formed. The white image of the region 204 was an image formed in the second rotation next to the rotation in which the image 208 was formed (reference rotation). The region 210 is a region corresponding to the image 208 in the region 204. Specifically, the regions 210L, 210C, and 210R are regions respectively corresponding to the images 208L, 208C, and 208R in the region 204.

(Transferring Performance Evaluation Criteria)

Evaluation A (very good): No images corresponding to the image 208 were observed in the region 210.

Evaluation B (good): Images corresponding to the image 208 were slightly observed in the region 210. The images were below a problematic level in practice.

Evaluation C (poor): Images corresponding to the image 208 were clearly observed in the region 210.

(Evaluation of Sensitivity Characteristics)

Sensitivity characteristics of each of the produced photosensitive members (A-2) to (A-13) and (B-1) to (B-9) were evaluated. Evaluation of sensitivity characteristics was performed in an environment at a temperature of 23° C. and a relative humidity of 50%. First, a surface of the photosensitive member was charged to +700 V using a drum sensitivity test device (product of Gen-Tech, Inc.). Next, monochromatic light (wavelength: 780 nm, half-width: 20 nm, optical intensity: 1.5 μJ/cm$^2$) was taken out from light of a halogen lamp using a bandpass filter. A surface of the photosensitive member was irradiated using the taken out monochromatic light. A surface potential of the photosensitive member was measured when 0.5 seconds elapsed from the start of the irradiation. The surface potential measured as above was taken to be a post-exposure potential ($V_L$, unit: +V). The measured post-exposure potentials $V_L$ of the photosensitive members are shown in Tables 3 and 4. A smaller absolute value of the post-exposure potential $V_L$ indicates more excellent electrical characteristics of the photosensitive member.

In Tables 3 and 4, "Resin" represents binder resin. "ETM" represents electron transport material. "HTM" represents hole transport material. "GCM Content Percentage" represents content percentage of the charge generating material (phthalocyanine pigment) relative to the mass of the photosensitive layer. "Sensitivity" represents post-exposure potential $V_L$. "E-1", "E-2", and "E-3" in the column "ETM" represents electron transport materials (ETM1-1), (ETM2-1), and (ETM3-1), respectively. "H-1", "H-2", and "H-3" in the column "HTM" represents hole transport materials (HTM-1), (HTM-2), and (HTM-3), respectively.

TABLE 3

| | Photosensitive member No. | Photosensitive layer: Resin | ETM | HTM | CGM content percentage (% by mass) | Film thickness (μm) | $Q_1$-$Q_2$ (μC) | Sensitivity characteristics Sensitivity (V) | Transferring performance Image evaluation |
|---|---|---|---|---|---|---|---|---|---|
| Example 1 | A-1 | R-1 | E-1 | H-1 | 0.72 | 28 | 5.67 | +136 | A |
| Example 2 | A-2 | R-1 | E-1 | H-1 | 0.92 | 28 | 5.95 | +125 | A |
| Example 3 | A-3 | R-1 | E-1 | H-1 | 1.12 | 28 | 6.28 | +112 | B |
| Example 4 | A-4 | R-1 | E-1 | H-1 | 1.33 | 28 | 6.48 | +106 | B |
| Example 5 | A-5 | R-2 | E-1 | H-1 | 0.92 | 28 | 6.01 | +123 | A |
| Example 6 | A-6 | R-3 | E-1 | H-1 | 0.92 | 28 | 5.98 | +122 | A |
| Example 7 | A-7 | R-4 | E-1 | H-1 | 0.92 | 28 | 6.03 | +124 | A |
| Example 8 | A-8 | R-1 | E-1 | H-1 | 0.92 | 25 | 6.45 | +132 | B |
| Example 9 | A-9 | R-1 | E-1 | H-1 | 0.92 | 32 | 5.78 | +121 | A |
| Example 10 | A-10 | R-1 | E-2 | H-1 | 0.92 | 28 | 6.03 | +127 | A |
| Example 11 | A-11 | R-1 | E-3 | H-1 | 0.92 | 28 | 6.10 | +124 | A |
| Example 12 | A-12 | R-1 | E-1 | H-2 | 0.92 | 28 | 6.12 | +134 | A |
| Example 13 | A-13 | R-1 | E-1 | H-3 | 0.92 | 28 | 6.11 | +139 | A |

TABLE 4

| | Photosensitive member No. | Photosensitive layer: Resin | ETM | HTM | CGM content percentage (% by mass) | Film thickness (μm) | $Q_1$-$Q_2$ (μC) | Sensitivity characteristics Sensitivity (V) | Transferring performance Image evaluation |
|---|---|---|---|---|---|---|---|---|---|
| Comparative Example 1 | B-1 | R-1 | E-1 | H-1 | 1.53 | 28 | 6.88 | +103 | C |
| Comparative Example 2 | B-2 | R-1 | E-1 | H-1 | 0.62 | 28 | 5.21 | +169 | C |
| Comparative Example 3 | B-3 | R-1 | E-1 | H-1 | 0.92 | 21 | 7.09 | +158 | C |
| Comparative Example 4 | B-4 | R-1 | E-1 | H-1 | 0.92 | 36 | 5.21 | +156 | C |
| Comparative Example 5 | B-5 | R-1 | E-4 | H-1 | 0.92 | 28 | 6.77 | +139 | C |

TABLE 4-continued

| | Photosensitive member No. | Photosensitive layer Resin | ETM | HTM | CGM content percentage (% by mass) | Film thickness (μm) | $Q_1$-$Q_2$ (μC) | Sensitivity characteristics Sensitivity (V) | Transferring performance Image evaluation |
|---|---|---|---|---|---|---|---|---|---|
| Comparative Example 6 | B-6 | R-1 | E-5 | H-1 | 0.92 | 28 | 6.89 | +123 | C |
| Comparative Example 7 | B-7 | R-1 | E-1 | H-4 | 0.92 | 28 | 6.68 | +142 | C |
| Comparative Example 8 | B-8 | R-1 | E-1 | H-5 | 0.92 | 28 | 6.56 | +138 | C |
| Comparative Example 9 | B-9 | R-5 | E-1 | H-1 | 0.92 | 28 | 6.62 | +118 | C |

As shown in Table 3, the photosensitive members (A-1) to (A-13) each included a single-layer photosensitive layer containing a charge generating material, a hole transport material, an electron transport material, and a binder resin. The content percentage of the phthalocyanine pigment being the charge generating material was each at least 0.72% by mass and no greater than 1.33% by mass relative to the mass of the photosensitive layer. The photosensitive layer had a film thick ness of 25 μm, 28 μm, and 32 μm. The charge amount difference was at least 5.67 μC and no greater than 6.48 μC.

As shown in Table 3, the photosensitive members (A-1) to (A-13) each had a post-exposure potential $V_L$ of at least +106 V and no greater than +139 V, and were evaluated as A (very good) or B (good) in terms of evaluation results of toner image transferring performance.

As shown in Table 4, the photosensitive members (B-1), (B-3), and (B-5) each had a charge amount difference of at least 6.56 μC and no greater than 7.09 μC. In the photosensitive members (B-1) and (B-2), the content percentage of the phthalocyanine pigment being a charge generating material was 1.53% by mass and 0.62% by mass relative to the mass of the photosensitive layer, respectively. The photosensitive members (B-3) and (B-4) had a film thick ness of 21 μm and 36 μm, respectively.

As shown in Table 4, the photosensitive members (B-2) to (B-4) each had a post-exposure potential $V_L$ of at least +156 V and no greater than +169 V. The photosensitive members (B-1) to (B-9) were evaluated as C (poor) in terms of evaluation results of toner image transferring performance.

From the above, the photosensitive members (A-1) to (A-13) have superior sensitivity characteristics and superior toner image transferring performance to the photosensitive members (B-1) to (B-9).

INDUSTRIAL APPLICABILITY

A photosensitive member according to the present invention can be suitably used in an electrophotographic image forming apparatus.

The invention claimed is:

1. An electrophotographic photosensitive member comprising a conductive substrate and a photosensitive layer, wherein the photosensitive layer is a single-layer photosensitive layer, the photosensitive layer contains a charge generating material, a hole transport material, an electron transport material, and a binder resin, the charge generating material is a phthalocyanine pigment, a content percentage of the phthalocyanine pigment relative to a mass of the photosensitive layer is at least 0.70% by mass and no greater than 0.92% by mass, the hole transport material is represented by a chemical formula (HTM-1) or (HTM-2), a film thickness of the photosensitive layer is at least 28 μm and no greater than 32 μm, a charge amount difference ΔQ of a surface of the photosensitive layer is no greater than 6.50 μC, and the charge amount difference ΔQ is calculated based on a mathematical expression (1)

$$\Delta Q = Q_1 - Q_2 \quad (1)$$

where in mathematical expression (1), $Q_1$ represents a charge amount of a non-exposed region of the surface of the photosensitive layer, $Q_2$ represents a charge amount of an exposed region of the surface of the photosensitive layer, the exposed region is a region of the surface of the photosensitive layer charged to +600 V and then irradiated with exposure light having a wavelength of 780 nm and an exposure amount of 1.2 μJ/cm$^2$, and the non-exposed region is a region of the surface of the photosensitive layer charged to +600 V and not irradiated with the exposure light thereafter (HTM-1)

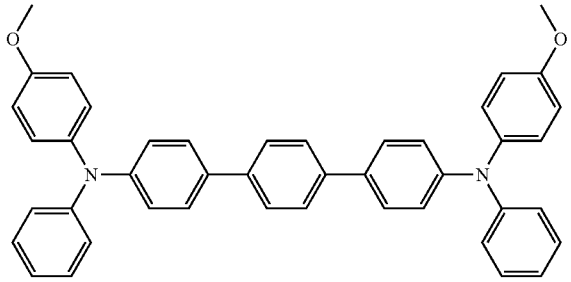

(HTM-2)

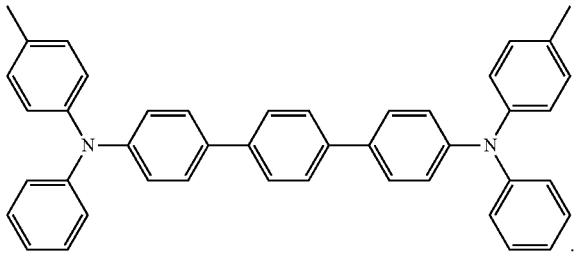

2. The electrophotographic photosensitive member according to claim 1, wherein the electron transport material is represented by a general formula (ETM1), (ETM2), or (ETM3)

(ETM1)

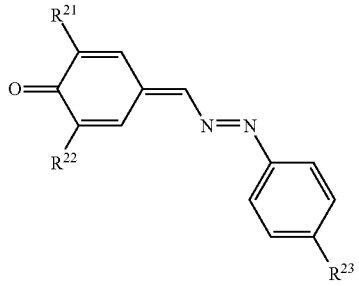

(ETM2)

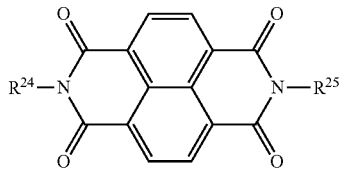

(ETM3)

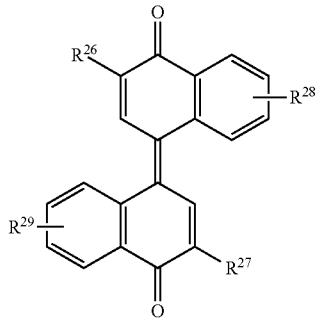

where in the general formula (ETM1), $R^{21}$ and $R^{22}$ each represent an alkyl group having a carbon number of at least 1 and no greater than 6, and $R^{23}$ represents a halogen atom, in the general formula (ETM2), $R^{24}$ and $R^{25}$ represent an aryl group having a carbon number of at least 6 and no greater than 14 and optionally having at least one alkyl group having a carbon number of at least 1 and no greater than 3, and in the general formula (ETM3), $R^{26}$, $R^{27}$, $R^{28}$, $R^{29}$ each represent, independently of one another, a hydrogen atom or an alkyl group having a carbon number of at least 1 and no greater than 6.

3. The electrophotographic photosensitive member according to claim 2, wherein the electron transport material is represented by a chemical formula (ETM1-1), (ETM2-1), or (ETM3-1)

(ETM1-1)

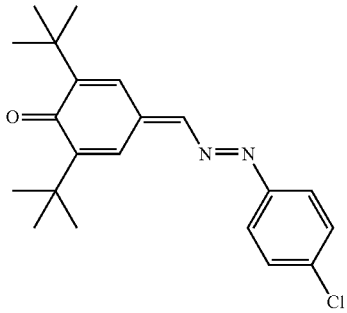

(ETM2-1)

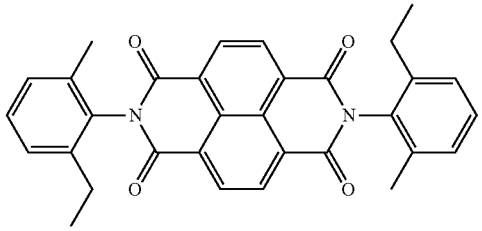

(ETM3-1)

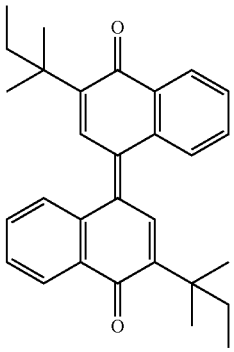

4. The electrophotographic photosensitive member according to claim 1, wherein the binder resin is represented by a general formula (R)

(R)

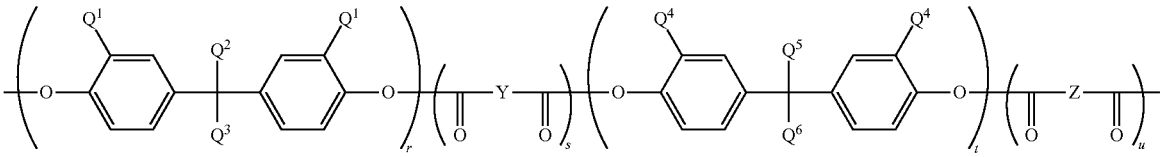

where in the general formula (R), $Q^1$ and $Q^4$ each represent, independently of each other, a hydrogen atom or a methyl group, $Q^2$, $Q^3$, $Q^5$, and $Q^6$ each represent, independently of one another, a hydrogen atom or an alkyl group having a carbon number of at least 1 and no greater than 4, $Q^2$ and $Q^3$ are different from each other, or $Q^2$ and $Q^3$ may be bonded to each other to form a ring, $Q^5$ and $Q^6$ are different from each other, or $Q^5$ and $Q^6$ may be bonded to each other to form a ring, r, s, t, and u each represent a number of at least 1 and no greater than 50, r+s+t+u=100 is satisfied, r+t=s+u is satisfied, and Y and Z are each represented, independently of each other, by chemical formula (1R), (2R), or (3R)

(1R)

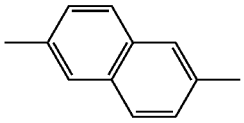

-continued (2R)

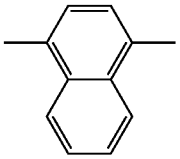

(3R)

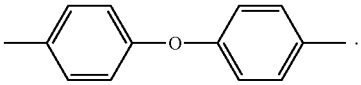

5. The electrophotographic photosensitive member according to claim 4, wherein the binder resin is represented by a chemical formula (R-1), (R-2), (R-3), or (R-4)

(R-1)

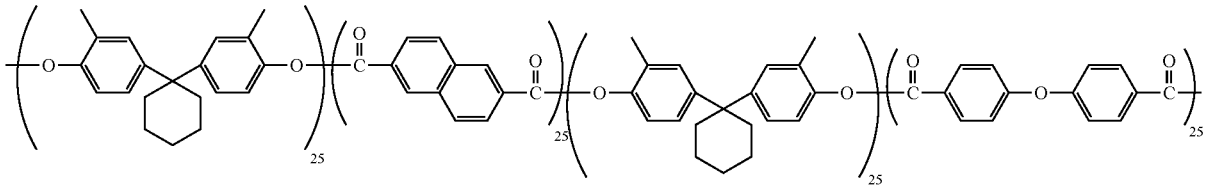

(R-2)

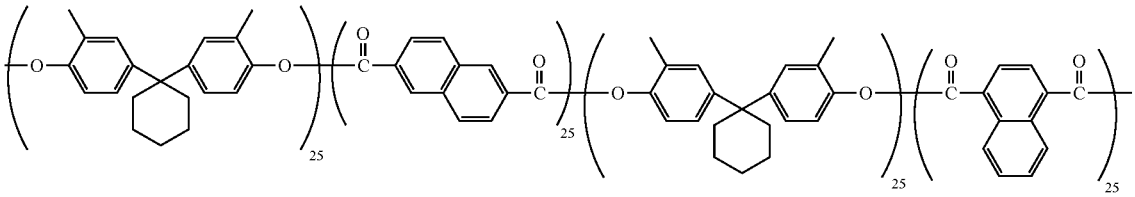

(R-3)

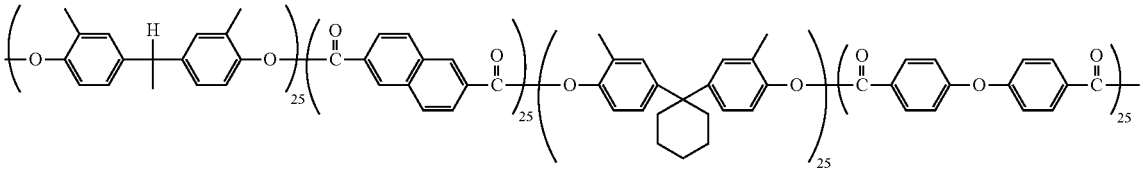

(R-4)

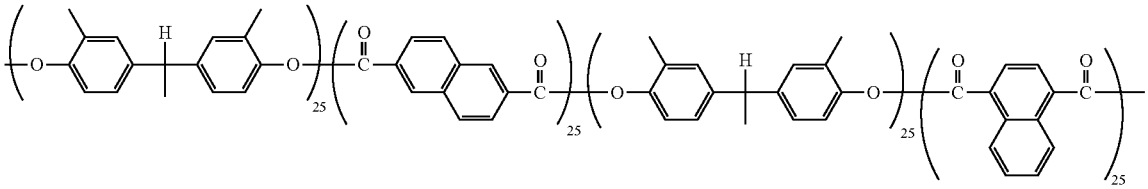

6. The electrophotographic photosensitive member according to claim 1, wherein the content percentage of the phthalocyanine pigment is at least 0.70% by mass and no greater than 0.92% by mass relative to the mass of the photosensitive layer, the film thickness of the photosensitive layer is at least 28 μm and no greater than 32 μm, and the charge amount difference ΔQ of the surface of the photosensitive layer is at least 4.00 μC and no greater than 6.20 μC.

7. The electrophotographic photosensitive member according to claim 6, wherein the hole transport material is represented by the chemical formula (HTM-1) or (HTM 2), the electron transport material is represented by a chemical formula (ETM1-1), (ETM2-1), or (ETM3-1), and the binder resin is represented by a chemical formula (R-1), (R-2), (R-3), or (R-4), (ETM1-1)

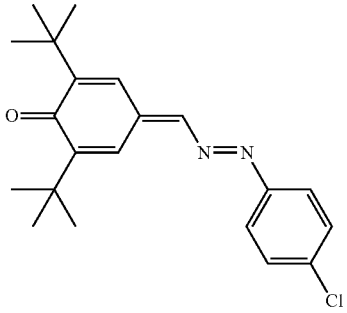

(ETM2-1)

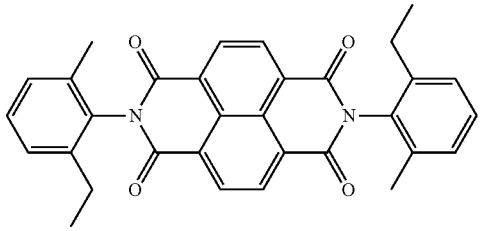

(ETM3-1)

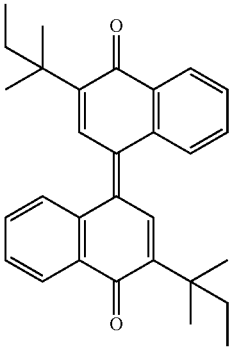

(R-1)

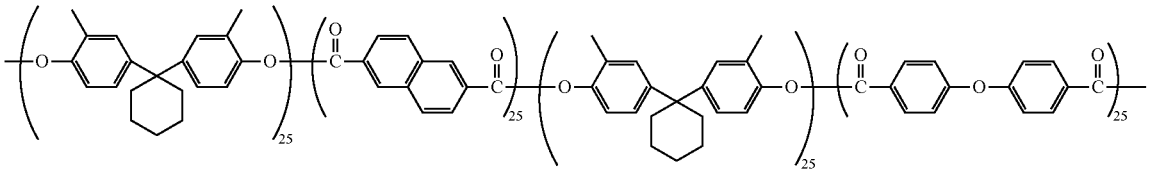

(R-2)

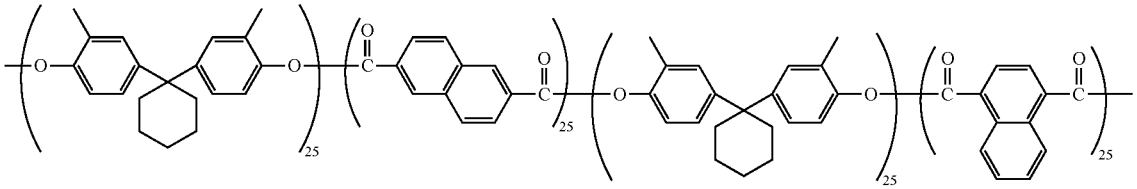

(R-3)

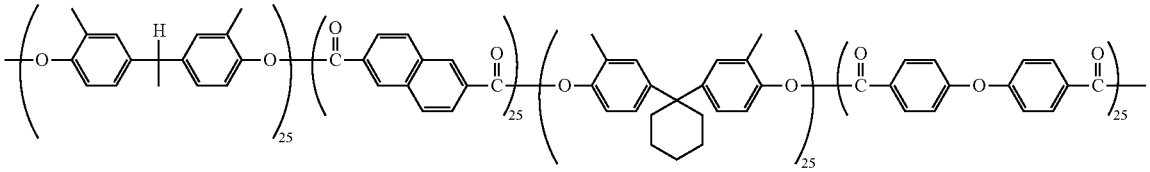

-continued (R-4)

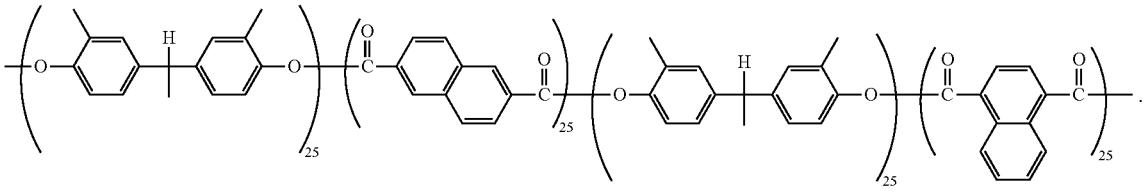

8. A process cartridge comprising the electrophotographic photosensitive member according to claim 1.

9. An image forming apparatus, comprising:

an image bearing member;

a charger configured to positively charge a surface of the image bearing member;

a light exposure section configured to form an electrostatic latent image by irradiating the charged surface of the image bearing member with exposure light, a developing section configured to develop the electrostatic latent image into a toner image, and a transfer section configured to transfer the toner image from the surface of the image bearing member to a recording medium, wherein the image bearing member is the electrophotographic photosensitive member according to claim 1.

10. The image forming apparatus according to claim 9, wherein the charger is a charging roller.

11. The image forming apparatus according to claim 9, wherein the developing section is configured to develop the electrostatic latent image into the toner image while in contact with the surface of the image bearing member.

12. The image forming apparatus according to claim 9, wherein the developing section is configured to clean the surface of the image bearing member.

* * * * *